US010508352B2

(12) United States Patent
Okuzono et al.

(10) Patent No.: US 10,508,352 B2
(45) Date of Patent: Dec. 17, 2019

(54) METHOD AND APPARATUS FOR PROCESSING A SUBSTRATE

(71) Applicant: Ebara Corporation, Tokyo (JP)

(72) Inventors: Takahisa Okuzono, Tokyo (JP); Jumpei Fujikata, Tokyo (JP)

(73) Assignee: EBARA Corporation, Tokyo (JP)

( * ) Notice: Subject to any disclaimer, the term of this patent is extended or adjusted under 35 U.S.C. 154(b) by 0 days.

(21) Appl. No.: 15/849,371

(22) Filed: Dec. 20, 2017

(65) Prior Publication Data

US 2018/0179656 A1 Jun. 28, 2018

(30) Foreign Application Priority Data

Dec. 28, 2016 (JP) ..... 2016-255283

(51) Int. Cl.

| | |
|---|---|
| ***C23C 18/18*** | (2006.01) |
| ***C25D 21/08*** | (2006.01) |
| ***C25D 21/12*** | (2006.01) |
| ***C25D 5/34*** | (2006.01) |
| ***C23C 18/16*** | (2006.01) |
| ***C25D 17/00*** | (2006.01) |
| ***C25D 17/06*** | (2006.01) |

(52) U.S. Cl.

CPC ..... *C25D 5/34* (2013.01); *C23C 18/163* (2013.01); *C23C 18/1827* (2013.01); *C25D 17/001* (2013.01); *C25D 17/004* (2013.01); *C25D 17/06* (2013.01); *C25D 21/08* (2013.01); *C25D 21/12* (2013.01)

(58) Field of Classification Search

CPC ..... C25D 5/34; C25D 17/001; C25D 17/004; C25D 17/06; C25D 21/08; C25D 21/12; C23C 18/163; C23C 18/1827

See application file for complete search history.

(56) References Cited

U.S. PATENT DOCUMENTS

2013/0255360 A1* 10/2013 Minami ..... C25D 17/004 73/40.5 R
2016/0102397 A1* 4/2016 Moore ..... C23C 16/0227 427/294

FOREIGN PATENT DOCUMENTS

JP 4664320 1/2011

* cited by examiner

*Primary Examiner* — Dah-Wei D. Yuan
*Assistant Examiner* — Jose Hernandez-Diaz
(74) *Attorney, Agent, or Firm* — Baker & Hostetler LLP

(57) ABSTRACT

A method which can perform a soft pre-wetting treatment of a substrate, such as a wafer, with use of a pre-wetting liquid in a smaller amount. This method includes: holding a substrate between a first holding member and a second holding member, with the surface of the substrate being exposed through an opening of the second holding member, and pressing a sealing ridge of the substrate holder against a peripheral portion of the substrate; pressing a sealing block against the substrate holder; forming a vacuum in an external space; performing a seal inspection to check a sealed state provided by the sealing ridge based on a change in pressure in the external space; and performing a pre-wetting treatment by supplying a pre-wetting liquid to the external space while evacuating air from the external space to bring the pre-wetting liquid into contact with the exposed surface of the substrate.

7 Claims, 13 Drawing Sheets

METHOD AND APPARATUS FOR PROCESSING A SUBSTRATE

CROSS REFERENCE TO RELATED APPLICATION

This document claims priority to Japanese Patent Application No. 2016-255283 filed Dec. 28, 2016, the entire contents of which are hereby incorporated by reference.

BACKGROUND

Plating technology is employed, for example, to deposit a metal in fine interconnect trenches or holes, or resist openings formed in a surface of a wafer, or to form bumps (protruding electrodes), which are to be electrically connected to package electrodes or the like, on a surface of a substrate. Plating technology is also employed to fill a metal into via holes in the production of an interposer or a spacer which has a large number of via plugs vertically penetrating therethrough and which is to be used in so-called three-dimensional packaging of semiconductor chips.

For example, it is common practice in TAB (Tape Automated Bonding) or flip chip to form protruding connection electrodes (bumps) of gold, copper, solder or nickel, or of multiple layers of such metals at predetermined portions (electrodes) of the surface of a semiconductor chip, having interconnects formed therein, so that the semiconductor chip can be electrically connected via the bumps to package electrodes or TAB electrodes.

Electroplating of a wafer is performed by applying a voltage between an anode and the wafer, which serves as a cathode, while keeping them immersed in a plating solution. In order to enable the plating solution to easily enter recesses or through-holes formed in the wafer surface, the wafer is subjected to a pre-wetting treatment which is to replace air, existing in the recesses or through-holes, with a pre-wetting liquid. The pre-wetting treatment is performed by immersing the wafer in the pre-wetting liquid held in a pre-wetting tank (see, for example, Japanese Patent No. 4664320).

However, in the above-described conventional pre-wetting treatment, the entire wafer is immersed in the pre-wetting liquid. Therefore, it is necessary to use a large amount of pre-wetting liquid. In addition, it takes considerable time to fill the pre-wetting liquid into the pre-wetting tank, and to discharge the pre-wetting liquid from the pre-wetting tank.

In order to solve such problems, a spray-type pre-wetting treatment has been proposed which involves spraying a pre-wetting liquid onto a wafer surface. However, the pre-wetting liquid with a high pressure can cause collapse of patterns formed on the water. With such a background, there is a demand for a soft pre-wetting technique which does not cause pattern collapse.

SUMMARY OF THE INVENTION

According to embodiments, there are provided a method and apparatus which can perform a soft pre-wetting treatment of a substrate, such as a wafer, with use of a pre-wetting liquid in a smaller amount as compared to the conventional pre-wetting treatment.

Embodiments, which will be described blow, relate to a method and an apparatus for replacing air in recesses or through-holes (e.g., via holes, trenches, resist openings, etc.), formed in a surface of a substrate such as a wafer, with a pre-wetting liquid by bringing the pre-wetting liquid into contact with the surface of the substrate prior to performing plating of the substrate.

In an embodiment, there is provided a method of processing a surface of a substrate while holding the substrate with a substrate holder including a first holding member and a second holding member, the second holding member having an opening, said method comprising: holding the substrate with the substrate holder by sandwiching the substrate between the first holding member and the second holding member, with the surface of the substrate being exposed through the opening of the second holding member, and pressing a sealing ridge of the substrate holder against a peripheral portion of the substrate; pressing a sealing block against the substrate holder to cover the sealing ridge, thereby forming an external space defined by the substrate holder, the exposed surface of the substrate, and the sealing block; forming a vacuum in the external space; performing a seal inspection to check a sealed state provided by the sealing ridge based on a change in pressure in the external space; and performing a pre-wetting treatment by supplying a pre-wetting liquid to the external space while evacuating air from the external space to bring the pre-wetting liquid into contact with the exposed surface of the substrate.

In an embodiment, the seal inspection and the pre-wetting treatment are performed successively in a pre-wetting tank.

In an embodiment, the seal inspection and the pre-wetting treatment are performed while keeping the substrate holder, holding the substrate, in a vertical position.

In an embodiment, the method further comprises: re-forming a vacuum in the external space after the seal inspection and before the pre-wetting treatment; and checking a sealed state provided by the sealing block based on a change in pressure in the external space.

In an embodiment, the method further comprises: discharging the pre-wetting liquid from the external space after the pre-wetting treatment; and then performing a pretreatment by supplying a pretreatment liquid to the external space to bring the pretreatment liquid into contact with the exposed surface of the substrate.

In an embodiment, the seal inspection, the pre-wetting treatment, and the pretreatment are performed successively in a pre-wetting tank.

In an embodiment, there is provided an apparatus for processing a surface of a substrate, comprising: a substrate holder configured to hold the substrate between a first holding member and a second holding member, the second holding member having an opening through which the surface of the substrate can be exposed, the substrate holder having a sealing ridge to be pressed against a peripheral portion of the substrate; a sealing block having a larger shape than the sealing ridge; an actuator configured to press the sealing block against the substrate holder; a vacuum line coupled to the sealing block; an on-off valve attached to the vacuum line; a processing controller configured to perform a seal inspection to check a sealed state provided by the sealing ridge based on a change in pressure in an external space formed by the substrate holder, the exposed surface of the substrate, and the sealing block; a pre-wetting liquid supply line coupled to the sealing block; and a pre-wetting liquid supply valve attached to the pre-wetting liquid supply line, wherein the processing controller is configured to keep the on-off valve and the pre-wetting liquid supply valve open simultaneously at least for a predetermined period of time.

In an embodiment, the apparatus further comprises a pre-wetting tank in which the seal inspection is performed and to which the pre-wetting liquid is supplied.

In an embodiment, the apparatus further comprises: a drain line coupled to the sealing block, the drain line communicating with the external space; and a pretreatment liquid supply line coupled to the sealing block, the pretreatment liquid supply line communicating with the external space.

In an embodiment, the apparatus further comprises a plating tank configured to immerse the substrate, held by the substrate holder, in a plating solution to plate the substrate.

In an embodiment, there is provided a non-transitory computer-readable storage medium that stores a program for causing a plating apparatus to perform a method of processing a surface of a substrate while holding the substrate with a substrate holder including a first holding member and a second holding member, the second holding member having an opening, said method comprising: holding the substrate with the substrate holder by sandwiching the substrate between the first holding member and the second holding member, with the surface of the substrate being exposed through the opening of the second holding member, and pressing a sealing ridge of the substrate holder against a peripheral portion of the substrate; pressing a sealing block against the substrate holder to cover the sealing ridge, thereby forming an external space defined by the substrate holder, the exposed surface of the substrate, and the sealing block; forming a vacuum in the external space; performing a seal inspection to check a sealed state provided by the sealing ridge based on a change in pressure in the external space; and performing a pre-wetting treatment by supplying a pre-wetting liquid to the external space while evacuating air from the external space to bring the pre-wetting liquid into contact with the exposed surface of the substrate.

According to the above-described embodiments, the external space is formed between the exposed surface of the substrate held by the substrate holder and the sealing block. The pre-wetting liquid is supplied only to this external space. This makes it possible to significantly reduce the use of the pre-wetting liquid as compared to the conventional method. Furthermore, since the pre-wetting liquid is injected into the external space while evacuating air from the external space, the pre-wetting liquid can easily enter recesses or through-holes formed in the substrate, thereby expelling air from the recesses or through-holes.

DESCRIPTION OF EMBODIMENTS

Embodiments will now be described in detail with reference to the drawings.

Figure 1:
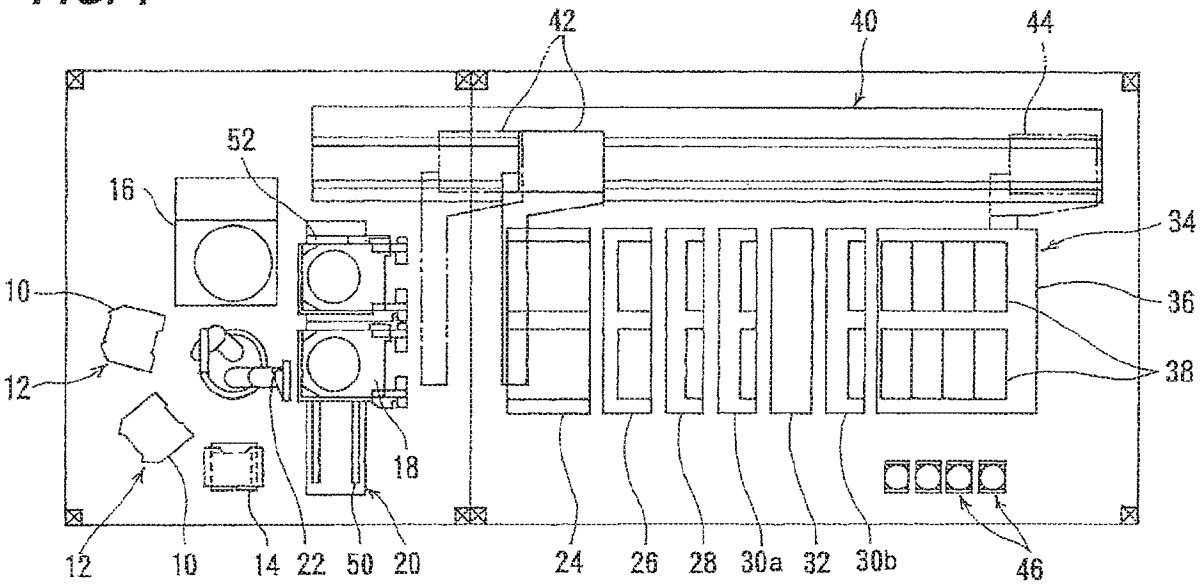
FIG. 1 is an overall layout plan of a plating apparatus.

FIG. 1 shows an overall layout plan view of a plating apparatus. As shown in FIG. 1, the plating apparatus includes two cassette tables 12 each receives thereon a cassette 10 in which substrates, such as wafers, are housed, an aligner 14 for aligning an orientation flat or a notch of a substrate in a predetermined direction, and a spin-rinse drier 16 for drying the substrate after plating by rotating it at a high speed. Near the spin-rinse drier 16 is provided a substrate loading unit 20 on which the substrate holder 18 is placed. This substrate loading unit 20 is configured to load the substrate into the substrate holder 18 and unload the substrate from the substrate holder 18. Further, in the center of these units is disposed a substrate transfer device 22 which is a transfer robot for transferring the substrate between these units.

The plating apparatus further includes a stock unit 24 for storing and temporarily storing substrate holders 18 therein, a pre-wetting tank 26 for immersing the substrate in pure water, a pretreatment tank 28 for etching away an oxide film formed on a surface of a film (e.g., a seed layer) of the substrate, a first water-cleaning tank **30*a* for cleaning the surface of the pre-soaked substrate, a blow tank 32 for draining the substrate after cleaning of the substrate, a plating tank 34 for plating the substrate, and a second water-cleaning tank 30*b* for cleaning the plated substrate. The stock unit 24, the pre-wetting tank 26, the pretreatment tank 28, the first water-cleaning tank 30*a*, the blow tank 32, the second water-cleaning tank 30*b*, and the plating tank 34 are arranged in this order from the substrate loading unit side. The plating tank 34 includes an overflow tank 36 and a plurality of plating cells 38 surrounded by the overflow tank 36. Each plating cell 38** is configured to receive one substrate therein and perform copper plating, metal plating (e.g., plating of Sn, Au, Ag, Ni, Ru, or In), or alloy plating (e.g., plating of Sn/Ag alloy, or Sn/In alloy) on the surface of the substrate.

The plating apparatus further includes a substrate-holder transport device 40 for transporting the substrate holder 18, together with the substrate, between the above-described tanks and units. This substrate-holder transport device 40 may be of a linear-motor type. The substrate-holder transport device 40 has a first transporter 42 for transporting the substrate between the substrate loading unit 20, the stock unit 24, and the pre-wetting tank 26, and a second transporter 44 for transporting the substrate between the stock unit 24, the pre-wetting tank 26, the pretreatment tank 28, the water-cleaning tank **30*a*, the second water-cleaning tank 30*b*, the blow tank 32, and the plating tank 34. The substrate-holder transport device 40 may include only the first transporter 42 without being provided with the second transporter 44. In this case, the first transporter 42 is configured to transport the substrate between the substrate loading unit 20, the stock unit 24, the pre-wetting tank 26, the pretreatment tank 28, the water-cleaning tank 30***a*, the second water-cleaning tank 30*b*, the blow tank 32, and the plating tank 34.

Paddle drive devices 46 are provided each for driving a paddle (not shown) disposed in each plating cell 38 as an agitator for agitating a plating solution. The paddle drive devices 46 are located next to the overflow tank 36 of the plating tank 34.

The substrate loading unit 20 includes a stage plate 52 which is laterally slidable along rails 50. Two substrate holders 18, parallel to each other, are placed horizontally on the stage plate 52. A substrate is transferred between one substrate holder 18 and the substrate transfer device 22, and then the stage plate 52 is slid laterally and the other substrate is transferred between the other substrate holder 18 and the substrate transfer device 22.

As shown in FIGS. 2 through 5, the substrate holder 18 includes a first holding member (base holding member) 54 having a rectangular plate shape and made of e.g., vinyl chloride, and a second holding member (movable holding member) 58 rotatably coupled to the first holding member 54 through a hinge 56 which allows the second holding member 58 to open and close with respect to the first holding member 54. Although in this embodiment the second holding member 58 is configured to be openable and closable through the hinge 56, it is also possible to dispose the second holding member 58 opposite to the first holding member 54 and to move the second holding member 58 away from and toward the first holding member 54 to thereby open and close the second holding member 58.

The second holding member 58 includes a base portion 60 and a seal holder 62. The seal holder 62 is made of, e.g., vinyl chloride so as to enable a below-described retaining ring 64 to slide well. An inwardly-projecting substrate-side sealing ridge (first sealing ridge) 66 is fixed to an upper surface of the seal holder 62. This substrate-side sealing ridge 66 is placed in pressure contact with a peripheral portion of the surface of the substrate W to seal a gap between the substrate W and the second holding member 58 when the substrate W is held by the substrate holder 18. A holder-side sealing ridge (second sealing ridge) 68 is fixed to a surface, facing the first holding member 54, of the seal holder 62. This holder-side sealing ridge 68 is placed in pressure contact with the first holding member 54 to seal a gap between the first holding member 54 and the second holding member 58 when the substrate W is held by the substrate holder 18. The holder-side sealing ridge 68 is located outwardly of the substrate-side sealing ridge 66.

The substrate-side sealing ridge (first sealing ridge) 66 and the holder-side sealing ridge (second sealing ridge) 68 are endless seals. The substrate-side sealing ridge 66 and the holder-side sealing ridge 68 may be sealing members, such as O-rings. In one embodiment, the second holding member 58 itself, including the substrate-side sealing ridge 66 and the holder-side sealing ridge 68, may be made of material having a sealing function. In the present embodiment, the substrate-side sealing ridge 66 and the holder-side sealing ridge 68 have an annular shape and are concentric. The holder-side sealing ridge 68 may be omitted.

Figure 5:
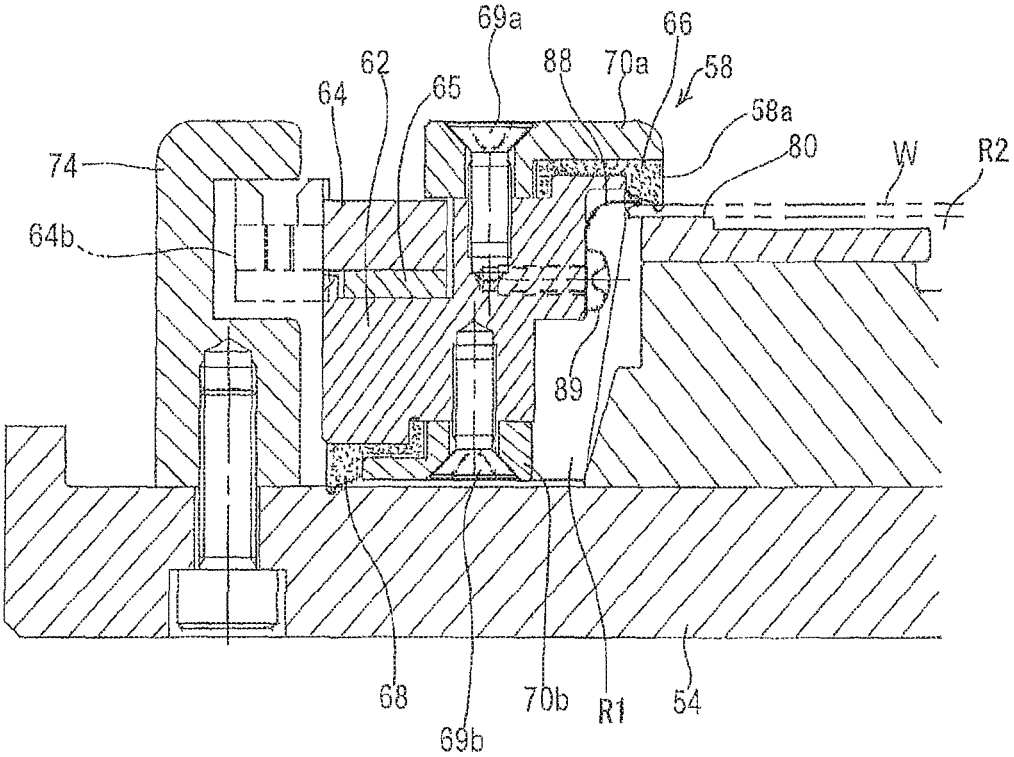
FIG. 5 is an enlarged view of a portion A of FIG. 4.

As shown in FIG. 5, the substrate-side sealing ridge (first sealing ridge) 66 is sandwiched between the seal holder 62 and a first mounting ring 70*a* which is secured to the seal holder 62 by fastening tools 69*a*, such as bolts. The holder-side sealing ridge (second sealing ridge) 68 is sandwiched between the seal holder 62 and a second mounting ring 70*b* which is secured to the seal holder 62 by fastening tools 69*b*, such as bolts, The seal holder 62 of the second holding member 58 has a stepped portion at a periphery thereof, and the retaining ring 64 is rotatable mounted to the stepped portion via a spacer 65. The retaining ring 64 is inescapably held by an outwardly projecting retaining plates 72 (see FIG. 3) mounted to a side surface of the seal holder 62. This retaining ring 64 is made of a material having high rigidity and excellent acid corrosion resistance, for example titanium, and the spacer 65 is made of a material having a low friction coefficient, for example PTFE, so that the retaining ring 64 can rotate smoothly.

Inverted L-shaped dampers 74, each having an inwardly projecting portion and located outside of the retaining ring 64, are provided on the first holding member 54 at equal intervals along a circumferential direction of the retaining ring 64. The retaining ring 64 has outwardly projecting portions 64*b* arranged along the circumferential direction of the retaining ring 64 at positions corresponding to positions of the dampers 74. A lower surface of the inwardly projecting portion of each damper 74 and an upper surface of each projecting portion 64*b* of the retaining ring 64 are tapered in opposite directions along the rotational direction of the retaining ring 64. A plurality (e.g., three) of upwardly protruding dots 64*a* are provided on the retaining ring 64 in predetermined positions along the circumferential direction of the retaining ring 64. The retaining ring 64 can be rotated by pushing each dot 64*a* from a lateral direction by means of a rotating pin (not shown).

When the second holding member 58 is open, the substrate W is placed onto the central portion of the first holding member 54, and the second holding member 58 is then closed through the hinge 56. Subsequently the retaining ring 64 is rotated clockwise so that each projecting portion 64*b* of the retaining ring 64 slides into the inwardly projecting portion of each damper 74. As a result, the first holding member 54 and the second holding member 58 are fastened to each other and locked by engagement between the tapered surfaces of the projecting portions 64*b* of the retaining ring 64 and the tapered surfaces of the dampers 74. The lock can be released by rotating the retaining ring 64 counterclockwise to disengage the projecting portions 64*b* of the retaining ring 64 from the inverted. L-shaped dampers 74.

When the second holding member 58 is locked in the above-described manner(i.e., the substrate W is held by the substrate holder 18), the lower end of the inner downwardly-protruding portion of the substrate-side sealing ridge 66 is placed in uniform pressure contact with the peripheral portion of the surface of the substrate W, whereby the gap between the second holding member 58 and the peripheral portion of the surface of the substrate W is sealed by the substrate-side sealing ridge 66. Similarly, the lower end of the outer downwardly-protruding portion of the holder-side sealing ridge 68 is placed in uniform pressure contact with the surface of the first holding member 54, whereby the gap between the first holding member 54 and the second holding member 58 is sealed by the holder-side sealing ridge 68.

The substrate holder 18 is configured to hold the substrate W by sandwiching the substrate W between the first holding member 54 and the second holding member 58. The second holding member 58 has a circular opening 58*a*, which is slightly smaller than the size of the substrate W. When the substrate W is interposed between the first holding member 54 and the second holding member 58, the surface, to be processed, of the substrate W is exposed through the opening 58*a*. Therefore, several types of processing liquids, such as a pre-wetting liquid, a pretreatment liquid, and a plating solution, which will be described later, can contact the exposed surface of the substrate W is held by the substrate holder 18. This exposed surface of the substrate W is surrounded by the substrate-side sealing ridge (first sealing ridge) 66.

Figure 2:
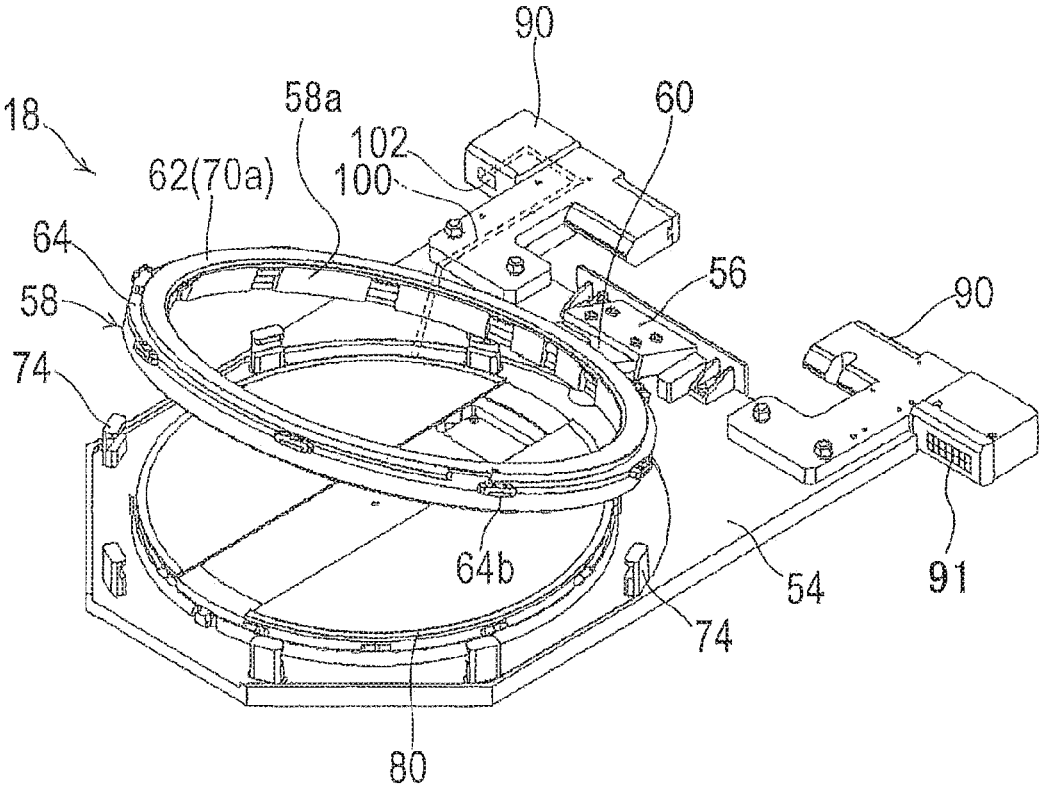
FIG. 2 is a perspective view schematically showing a substrate holder.
Figure 3:
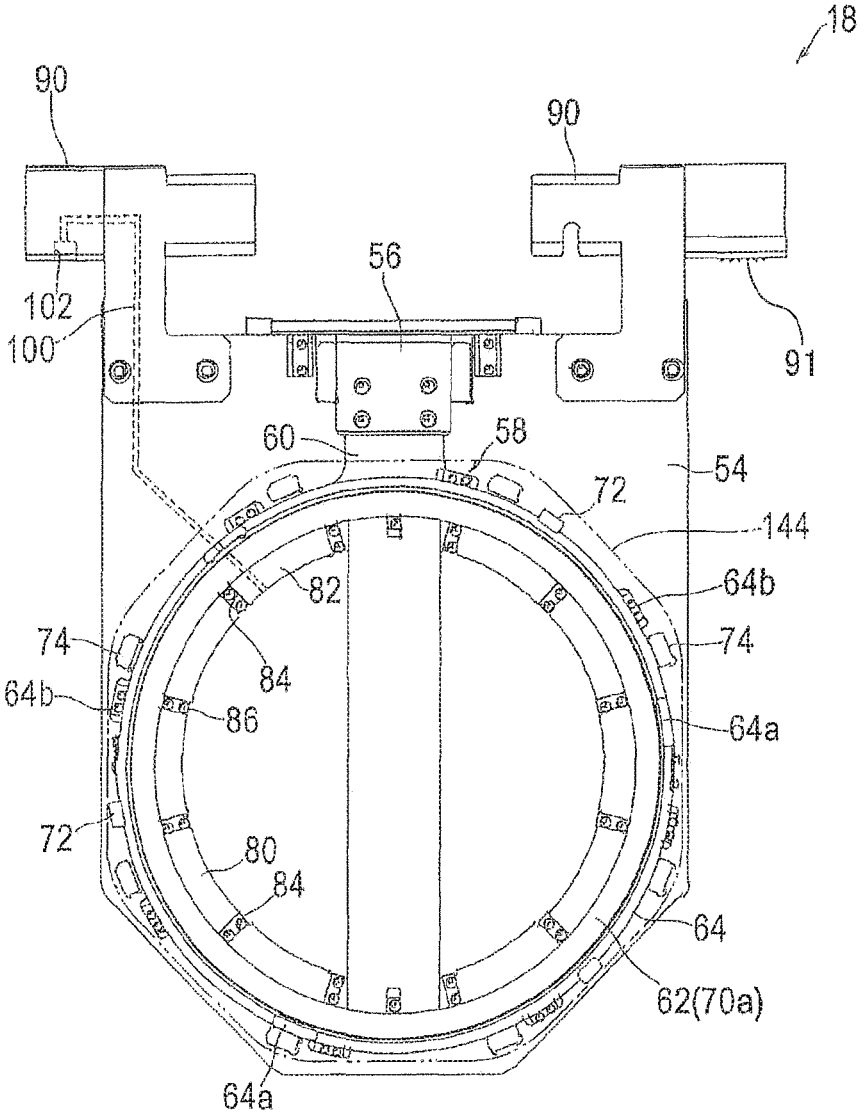
FIG. 3 is a plan view of the substrate holder shown in FIG. 2.
Figure 4:
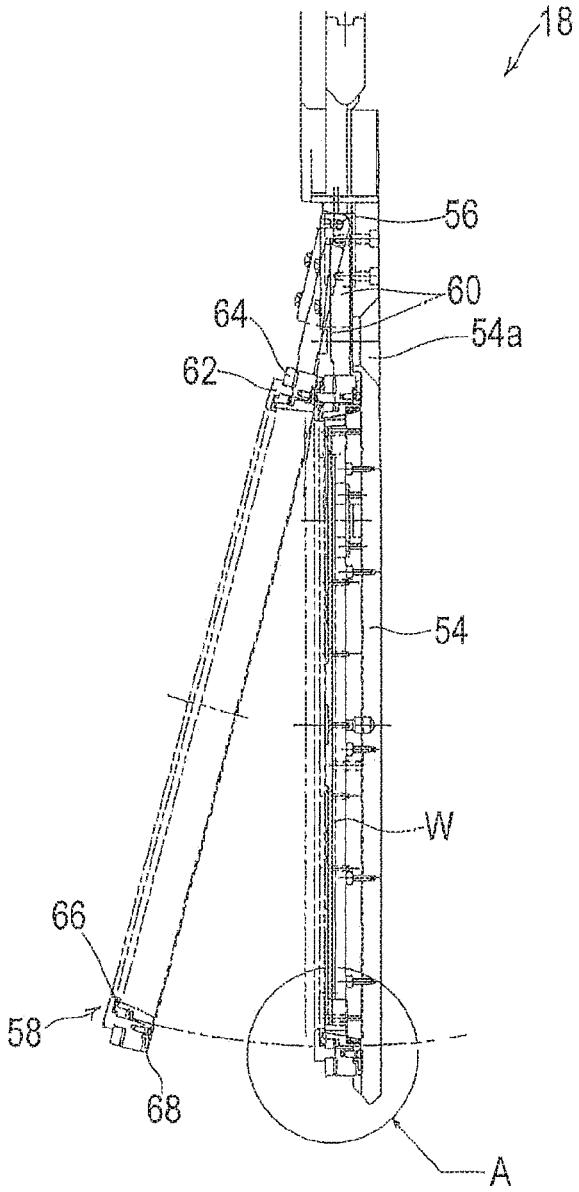
FIG. 4 is a right side view of the substrate holder shown in FIG. 2.

When the substrate W is held by the substrate holder 18, a first internal space R1 (which will be simply referred to as internal space R1) is formed in the substrate holder 18 as shown in FIG. 5. An inner circumferential side of the internal space R1 is sealed by the substrate side sealing ridge 66, and an outer circumferential side of the internal space R1 is sealed by the holder-side sealing ridge 68. Further, a second internal space R2 (which will be simply referred to as internal space R2) is formed between the first holding member 54 of the substrate holder 18 and a surface of the substrate W which is located at the opposite side from the exposed surface. The internal space R1 and the internal space R2 are in fluid communication with each other through passages (which will be discussed later). As shown in FIG. 2 and FIG. 3, the internal space R2 is coupled to an internal passage 100 formed in the first holding member 54. This internal passage 100 is in fluid communication with a suction port 102 formed in a hand 90 of the substrate holder 18.

The first holding member 54 has a protruding portion 82 in a ring shape corresponding to the size of the substrate W. The protruding portion 82 has a support surface 80 which contacts the peripheral portion of the substrate W to support the substrate W. The protruding portion 82 has recesses 84 arranged at predetermined positions along a circumferential direction of the protruding portion 82.

As shown in FIG. 3, a plurality of electrical conductors (electrical contacts) 86 (e.g., twelve conductors as illustrated) are disposed in the recesses 84, respectively. These electrical conductors 86 are coupled respectively to wires extending from external contacts 91, which are provided on a hand 90. When the substrate W is placed on the support surface 80 of the first holding member 54, ends of the electrical conductors 86 are exposed in a springy state on the surface of the first holding member 54 at positions beside the substrate W to contact lower portions of electrical contacts 88 shown in FIG. 5.

The electrical contacts 88, to be electrically connected to the electrical conductors 86, are secured to the seal holder 62 of the second holding member 58 by fastening tools 89, such as bolts. The electrical contacts 88 each have a leaf spring shape. Specifically, the electrical contacts 88 each have a leaf spring shape-like contact portion lying outside the substrate-side sealing ridge 66 and projecting inwardly. This contact portion is springy and bends easily. When the substrate W is held by the first holding member 54 and the second holding member 58, the contact portions of the electrical contacts 88 make elastic contact with the peripheral surface of the substrate W supported on the support surface 80 of the first holding member 54.

The second holding member 58 is opened and closed by a not-shown pneumatic cylinder and by the own weight of the second holding member 58. More specifically, a through-hole 54*a* is formed in the first holding member 54, and the pneumatic cylinder is provided so as to face the through-hole 54*a* when the substrate holder 18 is placed on the substrate loading unit 20. The second holding member 58 is opened by extending a piston rod of the pneumatic cylinder to lift up a pressing rod (not shown) through the through-hole 54*a* to thereby push up the seal holder 62 of the second holding member 58. The second holding member 58 is closed by its own weight when the piston rod is retracted.

A pair of approximately T-shaped hands 90 is coupled to the end of the first holding member 54 of the substrate holder 18. These hands 90 serve as a support when the substrate holder 18 is being transported and when the substrate holder 18 is being held in a suspended state. In the stock unit 24, the hands 90 are placed on an upper surface of a peripheral wall of the stock unit 24, whereby the substrate holder 18 is suspended in a vertical position. When the substrate holder 18 is to be transported from the stock unit 24, the hands 90 of the suspended substrate holder 18 are gripped by the transporter 42 or 44 of the substrate-holder transport device 40. Also in the pre-wetting tank 26, the pretreatment tank 28, the water-cleaning tank 30*a*, the second water-cleaning tank 30*b*, the blow tank 32, and the plating tank 34, the substrate holder 18 is held in a suspended state with the hands 90 placed on a peripheral wall of each tank. As shown in FIG. 2 and FIG. 3, the suction port 102 is provided in the hand 90 of the substrate holder 18.

A sequence of processes performed by the above-described plating apparatus will now be described. First, one substrate is removed from the cassette 10 mounted on the cassette table 12 by the substrate transfer device 22. The substrate is placed on the aligner 14, which then aligns an orientation flat or a notch of the substrate in a predetermined direction. After the alignment performed by the aligner 14, the substrate is transported to the substrate loading unit 20 by the substrate transfer device 22.

Two substrate holders 18 stored in the stock unit 24 are simultaneously gripped by the first transporter 42 of the substrate-holder transport device 40, and transported to the substrate loading unit 20. The substrate holders 18 are lowered in a horizontal position until the two substrate holders 18 are simultaneously placed on the stage plate 52 of the substrate loading unit 20. Two pneumatic cylinders are then actuated to open the second holding members 58 of the substrate holders 18, respectively.

In this state, the substrate is inserted into the center-side substrate holder 18 by the substrate transfer device 22, and the pneumatic cylinder is reversely actuated to close the second holding member 58. The second holding member 58 is then locked by means of a locking and unlocking mechanism provided above the substrate loading unit 20. After completion of the loading of the substrate into the substrate holder 18, the stage plate 52 is slid laterally, and a substrate is then loaded into the other substrate holder 18 in the same manner. Thereafter, the stage plate 52 is returned to its original position.

The substrate holder 18 holds the substrate with its surface, to be processed, exposed through the opening 58*a* of the substrate holder 18. The substrate-side sealing ridge 66 seals the gap between the peripheral portion of the substrate and the second holding member 58, while the holder-side sealing ridge 68 seals the gap between the first holding member 54 and the second holding member 58 so as not to allow the plating solution to enter the internal space R1. These sealing ridges 66 and 68 enable electrical connection between the electrical contacts 88 and a portion of the substrate W that does not contact the plating solution. The wires extend from the electrical contacts 88 to the external contacts 91 provided on the hand 90 of the substrate holder 18. Therefore, an electric current can be fed to a conductive film (e.g., a seed layer) of the substrate by establishing electrical connection between a power source and the external contacts 91.

The substrate holder 18 holding the substrate is transported to the pre-wetting tank 26 by the first transporter 42 of the substrate-holder transport device 40. In this pre-wetting tank 26, a seal inspection and a pre-wetting treatment are performed in this order. The seal inspection is a process of checking whether a sealed state is properly established by the substrate-side sealing ridge (first sealing ridge) 66 and/or the holder-side sealing ridge (second sealing ridge) 68. The pre-wetting treatment is a process of imparting a hydrophilicity to the surface of the substrate by bringing a pre-wetting liquid into contact with the surface of the substrate held by the substrate holder 18. In this embodiment, pure water is used as the pre-wetting liquid, while other type of liquid may be used. For example, the pre-wetting liquid may be a liquid containing the same components as those contained in the plating solution. If the plating solution is a copper sulfate plating solution, the pre-wetting liquid may be an aqueous solution containing at least one of dilute sulfuric acid, metal ions, chloride ions, and additives (e.g., accelerator, suppressor, and leveler).

Although not shown, instead of providing the substrate loading unit 20 on which two substrate holders 18 are placed horizontally, it is possible to provide a fixing station which is configured to receive two substrate holders from the first transporter 42 and support the two substrate holders vertically (or in an inclined state with a small angle with respect to the vertical direction). The substrate holders can be brought into a horizontal position by rotating the fixing station, holding the substrate holders in the vertical position, by 90 degrees.

Although in this embodiment the one locking and unlocking mechanism is provided, it is possible to provide two locking and unlocking mechanisms adjacent to each other and to simultaneously perform locking and unlocking of two substrate holders by the two locking and unlocking mechanisms.

Next, the two substrate holders 18 holding the substrates are transported to the pretreatment tank 28 in the same manner as described above. In the pretreatment tank 28, an oxide film on each substrate is etched away, so that a clean metal surface is exposed. Thereafter, the substrate holders 18 holding the substrates are transported to the first water-cleaning tank 30*a* in the same manner as described above, and the surface of each substrate is cleaned with pure water held in the first water-cleaning tank 30*a*.

After cleaning of the substrates, the two substrate holders 18 holding the substrates are gripped by the second transporter 44 of the substrate-holder transport device 40 and are transported to the plating tank 34 which is tilled with the plating solution. Each substrate holder 18 is suspended and held at a predetermined position in one of the plating cells 38. The second transporter 44 of the substrate-holder transport device 40 sequentially repeats the above operations to sequentially transport the substrate holders 18 to the plating cells 38 of the plating tank 34 and suspend the substrate holders 18 in the plating cells 38 at predetermined positions.

After suspending the substrate holders 18 in all the plating cells 38 is completed, plating of the surface of each substrate is performed in the following manner. A plating voltage is applied between each substrate W and an anode (not shown) in the plating cell 38, while the paddle immersed in the plating solution is reciprocated parallel to the surface of the substrate by the paddle drive device 46, so that the surface of the substrate is plated. During plating of the substrate, the substrate holder 18 is suspended from the top of the plating cell 38 through the hands 90, so that electricity is fed from the plating power source to a film (e.g., a seed layer) of the substrate through the electrical conductors 86 and the electrical contacts 88. The plating solution circulates from the overflow tank 36 to the plating cell 38 through a circulation line (not shown) basically at all times during operations of the plating apparatus. The plating solution is maintained at a constant temperature by a constant-temperature device provided on the circulation line.

After the completion of plating, the application of the plating voltage and the reciprocation of the paddle are stopped. Thereafter, two substrate holders 18 holding the plated substrates W are gripped by the second transporter 44 of the substrate-holder transport device 40, and are transported to the second water-cleaning tank 30*b* in the same manner as described above, so that the surface of each substrate is cleaned with pure water held in the second water-cleaning tank 30*b*.

After cleaning, the substrate holders 18 holding the substrates are transported to the blow tank 32 in the same manner as described above. In the blow tank 32, air or N2 gas blows toward the substrates held by the substrate holders 18 to remove water droplets from the substrate holders 18 and the substrates held by the substrate holders 18 to thereby dry the substrates and the substrate holders 18.

The second transporter 44 of the substrate-holder transport device 40 sequentially repeats the above operations to successively transfer the substrate holders 18, each holding the plated substrate, to the blow tank 32.

The substrate holders 18, which have been dried in the blow tank 32, are gripped by the first transporter 42 of the substrate-holder transport device 40 and are placed on the stage plate 52 of the substrate loading unit 20.

The second holding member 58 of the center-side substrate holder 18 is firstly unlocked by the locking and unlocking mechanism, and the pneumatic cylinder is actuated to open the second holding member 58. It is preferable to provide a spring element (not shown), in addition to the electrical contacts 88, on the second holding member 58 so as to prevent the substrate from sticking to the second holding member 58 when it opens. Thereafter, the plated substrate is removed from the substrate holder 18 by the substrate transfer device 22 and transported to the spin-rinse drier 16, where the substrate is cleaned with pure water and then spin-dried (drained) by high-speed rotation of the spin-rinse drier 16. The dried substrate is returned to the cassette 10 by the substrate transfer device 22.

After or simultaneously with returning the substrate to the cassette 10, the stage plate 52 is slid laterally and the other substrate is removed from the other substrate holder 18. The substrate is then spin-rinse-dried by the spin-rinse drier 16, and the dried substrate is returned to the cassette 10 in the same manner.

A new substrate is loaded into the substrate holder 18 from which the plated substrate has been removed, and the new substrate is subjected to the sequential processes. When there is no new substrate to be processed, the substrate holder 18 with no substrate is gripped by the first transporter 42 of the substrate-holder transport device 40 and returned to a predetermined place in the stock unit 24.

In this manner, all the substrates are removed from the substrate holders 18, spin-dried by the spin-rinse drier 16, and returned to the cassette 10. The sequence of operations is completed when all the substrates have been plated, cleaned, and dried and all the substrate holders 18 are returned to predetermined places in the stock unit 24.

Figure 6:
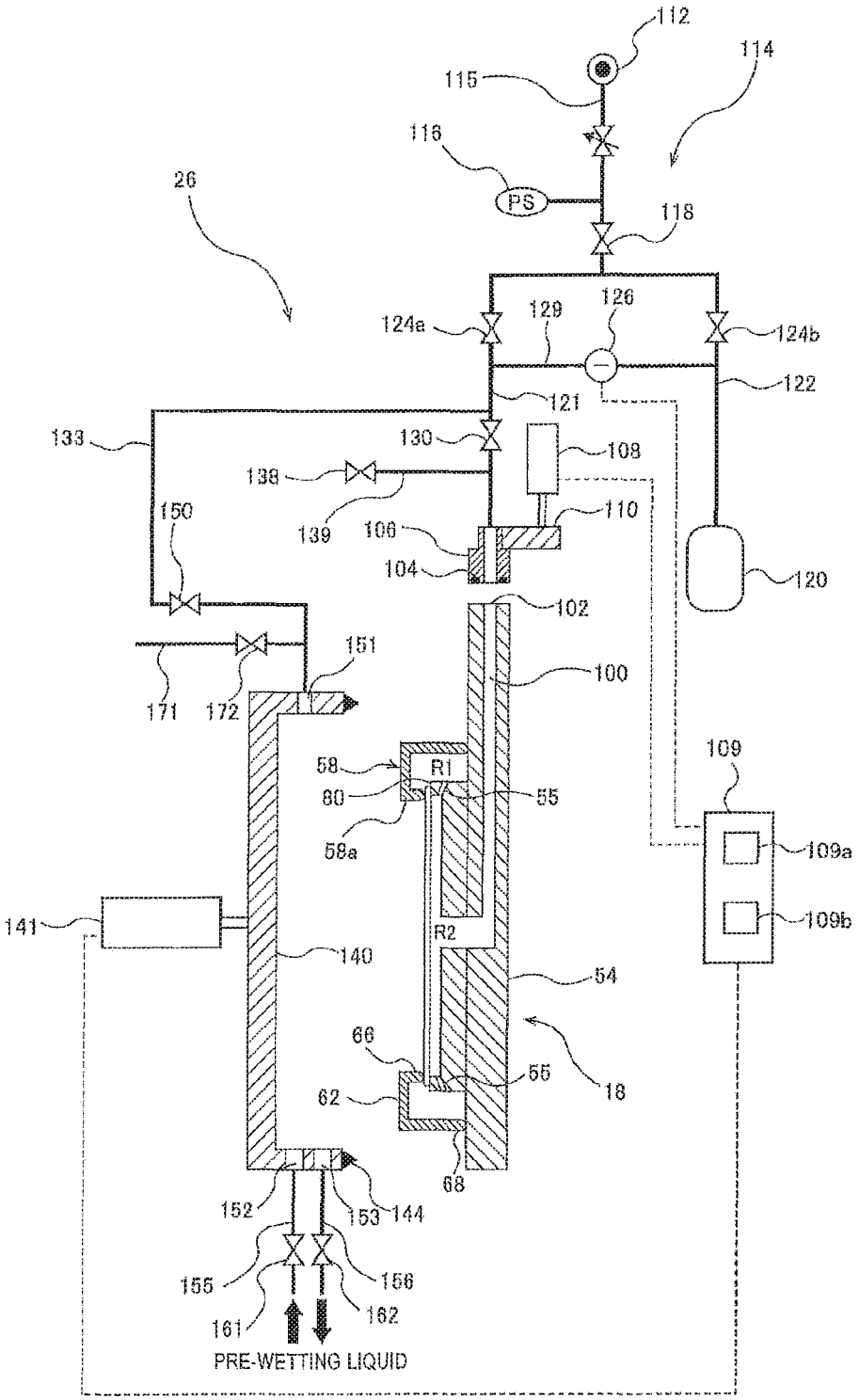
FIG. 6 is a diagram showing an embodiment of a construction for performing a seal inspection and a pre-wetting treatment.

The above-described seal inspection and pre-wetting treatment, performed in the pre-wetting tank 26, will now be described in detail. The seal inspection and the pre-wetting treatment are performed successively in this order. FIG. 6 is a diagram showing an embodiment of a construction for performing the seal inspection and the pre-wetting treatment. As schematically shown in FIG. 6, the pre-wetting tank 26 is provided with a suction coupling 106 having a sealing ring 104, and an actuator 108, such as an air cylinder, coupled to the suction coupling 106 via a coupling plate 110. The actuator 108 is configured to press the sealing ring 104 of the suction coupling 106 against the suction port 102 of the substrate holder 18, thereby coupling the suction coupling 106 to the substrate holder 18. The actuator 108 operates according to instructions from a processing controller 109. All of on-off valves, which will be described below, operate according to instructions from the processing controller 109.

The processing controller 109 includes a storage device 109*a* and an arithmetic device 109*b*. The storage device 109*a* may be a hard disk drive (HDD) or a solid state drive (SSD). A CPU (Central Processing Unit) may be used as the arithmetic device 109*b*. A program is stored in advance in the storage device 109*a*. The arithmetic device 109*b* operates according to the program. The processing controller 109 may be a computer. A program for causing the plating apparatus to perform the below-described method of processing a substrate surface may be stored in a non-transitory computer-readable storage medium.

In this embodiment, the seal inspection and the pre-wetting treatment are performed while keeping the substrate holder 18, holding a substrate W, in a vertical position. Thus, the substrate holder 18 holding the substrate W is disposed in a vertical position in the pre-wetting tank 26. In one embodiment, the seal inspection and the pre-wetting treatment may be performed while keeping the substrate holder 18, holding the substrate W, in a horizontal position. For example, the substrate holder 18, holding the substrate W with its to-be-processed surface facing downward, may be disposed in the pre-wetting tank 26. In that case, the holder-side sealing ridge 68 may be omitted.

When the substrate w is held by the substrate holder 18, the internal space R1, sealed with the sealing ridges 66, 68, is formed around the substrate W, and the internal space R2 is formed between the back surface (at the opposite side from the surface exposed through the opening 58*a*) of the substrate W and the first holding member 54. The internal space R1 and the internal space R2 communicate with each other through passages 55. The edge portion of the substrate W and the electrical contacts 88 are located in the internal space R1, and the back surface of the substrate W faces the internal space R2. The internal space R2 communicates with the suction port 102 through the internal passage 100. The support surface 80, serving as a support projection for supporting the back surface of the substrate W, is disposed around the internal space R2. The support projection may be a member whose surface is coated with an elastic film.

In the pre-wetting tank 26 are also disposed a sealing block 140 having a shape that can cover the opening 58*a* of the substrate holder 18, and an actuator 141 which presses the sealing block 140 against the substrate holder 18. The actuator 141 operates according to instructions from the processing controller 109. The sealing block 140 and the suction coupling 106 are coupled to a vacuum line 114 extending from a vacuum source 112 such as a vacuum pump. The vacuum line 114 includes a main suction line 115 coupled to the vacuum source 112, a holder suction line 121 and a differential-pressure check line 122 branching off from the main suction line 115, and a sealing-block suction line 133 branching off from the holder suction line 121. The distal end of the holder suction line 121 is coupled to the above-described suction coupling 106. Therefore, the holder suction line 121 can be coupled to the substrate holder 18 via the suction coupling 106.

The main suction line 115 is provided with a pressure sensor 116 for measuring pressure in the vacuum line 114, and further provided with a main on-off valve 118. One end of the differential-pressure check line 122 is coupled to the main suction line 115, while the other end of the differential-pressure check line 122 is coupled to a master container 120 in which no gas leak is guaranteed. The differential-pressure check line 122 is provided with an on-off valve 124*b*. The holder suction line 121 is provided with an on-off valve 124*a* and an on-off valve 130. The on-off valve 130 is located upstream of the on-off valve 124*a*. Thus, the on-off valve 130 is located between the on-off valve 124*a* and the suction coupling 106. A vent line 139, provided with a vent valve 138, is coupled to the holder suction line 121. A connection point of the vent line 139 and the holder suction line 121 is located between the on-off valve 130 and the suction coupling 106.

The holder suction line 121 and the differential-pressure check line 122 are coupled by a bridge line 129. A connection point of the bridge line 129 and the holder suction line 121 is located between the on-off valve 124*b* and the on-off valve 130. A connection point of the bridge line 129 and the differential-pressure check line 122 is located between the on-off valve 124*b* and the master container 120. The bridge line 129 is provided with a differential-pressure sensor 126 which is configured to be capable of measuring a difference between pressure in the holder suction line 121 and pressure in the differential-pressure check line 122. The differential-pressure sensor 126 is coupled to the processing controller 109, so that an output signal of the differential-pressure sensor 126 is sent to the processing controller 109.

The sealing block 140 is a lid which can cover the exposed surface of the substrate W held by the substrate holder 18. The sealing block 140 has a structure that does not permit passage of a fluid. An exhaust port 151, a pre-wetting liquid supply port 152, and a drain port 153 are formed in the sealing block 140. The exhaust port 151 is located at the top of the sealing block 140 disposed in a vertical position, while the pre-wetting liquid supply port 152 and the drain port 153 are disposed at the bottom of the sealing block 140 disposed in a vertical position. Thus, the pre-wetting liquid supply port 152 and the drain port 153 are located on the opposite side of the sealing block 140 from the exhaust port 151.

In this embodiment, the exhaust port 151, the pre-wetting liquid supply port 152, and the drain port 153 are located around the second holding member 58 of the substrate holder 18. More specifically, the exhaust port 151 is located above the second holding member 58, while the pre-wetting liquid supply port 152 and the drain port 153 are located below the second holding member 58. Accordingly, the exhaust port 151 is located higher than the exposed surface of the substrate W, while the pre-wetting liquid supply port 152 and the drain port 153 are located lower than the exposed surface of the substrate W.

A pre-wetting liquid supply line 155 and a drain line 156 are coupled to the pre-wetting liquid supply port 152 and the drain port 153, respectively. The pre-wetting liquid supply line 155 and the drain line 156 are provided with a pre-wetting liquid supply valve 161 and a drain valve 162, respectively.

The sealing-block suction line 133 branches off from the holder suction line 121 and is coupled to the exhaust port 151 of the sealing block 140. A connection point of the sealing-block suction line 133 and the holder suction line 121 is located between the on-off valve 130 and the on-off valve 124*a*. The sealing-block suction line 133 is provided with an on-off valve 150. A vent line 171, provided with a vent valve 172, is coupled to the sealing-block suction line 133. The vent line 171 is located between the on-off valve 150 and the exhaust port 151.

The sealing block 140, at its edge, has an endless partition seal 144. In this embodiment, the partition seal 144 has an annular shape. When the sealing block 140 is pressed against the substrate holder 18 by the actuator 141, the partition seal 144 comes into contact with the first holding member 54 of the substrate holder 18. The sealing block 140 has a larger size than the sealing ridges 66, 68 of the second holding member 58. The sealing ridges 66, 68 and the exposed surface of the substrate W are covered by the sealing block 140.

Figure 7:
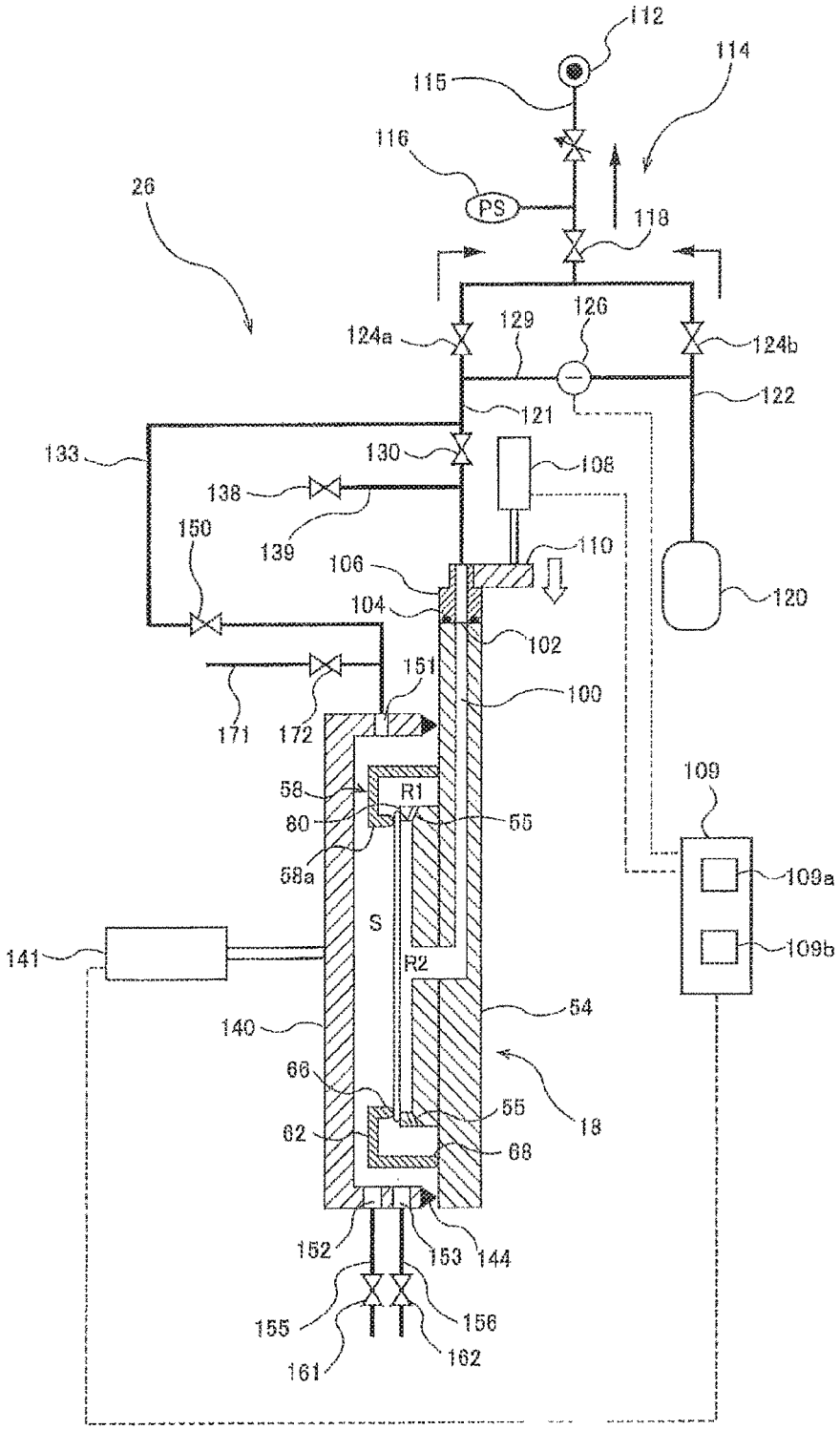
FIG. 7 is a diagram showing a substrate holder and a sealing block when a seal inspection and a pre-wetting treatment are performed.

A description will now be given of the seal inspection and the pre-wetting treatment which are performed in the pre-wetting tank 26. FIG. 7 is a diagram showing the substrate holder 18 and the sealing block 140 when the seal inspection and the pre-wetting treatment are performed. The substrate holder 18 holding the substrate W is disposed in a vertical position in the pre-wetting tank 26. The seal inspection and the pre-wetting treatment are performed successively in the order of the seal inspection and the pre-wetting treatment while the substrate holder 18 is kept in the same position in the pre-wetting tank 26. As shown in FIG. 7, prior to the seal inspection, the actuator 108 presses the sealing ring 104 of the suction coupling 106 against the suction port 102 of the substrate holder 18, thereby coupling the holder suction line 121 of the vacuum line 114 to the substrate holder 18.

Further, the actuator 141 presses the partition seal 144 of the sealing block 140 against the first holding member 54 of the substrate holder 18. The surface of the substrate W, exposed through the opening 58*a*, is covered by the sealing block 140. An external space S is formed by the sealing block 140, the exposed surface of the substrate W, and the substrate holder 18. The external space S communicates with the sealing-block suction line 133 of the vacuum line 114, the pre-wetting liquid supply line 155, and the drain line 156 through the exhaust port 151, the pre-wetting liquid supply port 152, and the drain port 153, respectively, of the sealing block 140.

Figure 8:
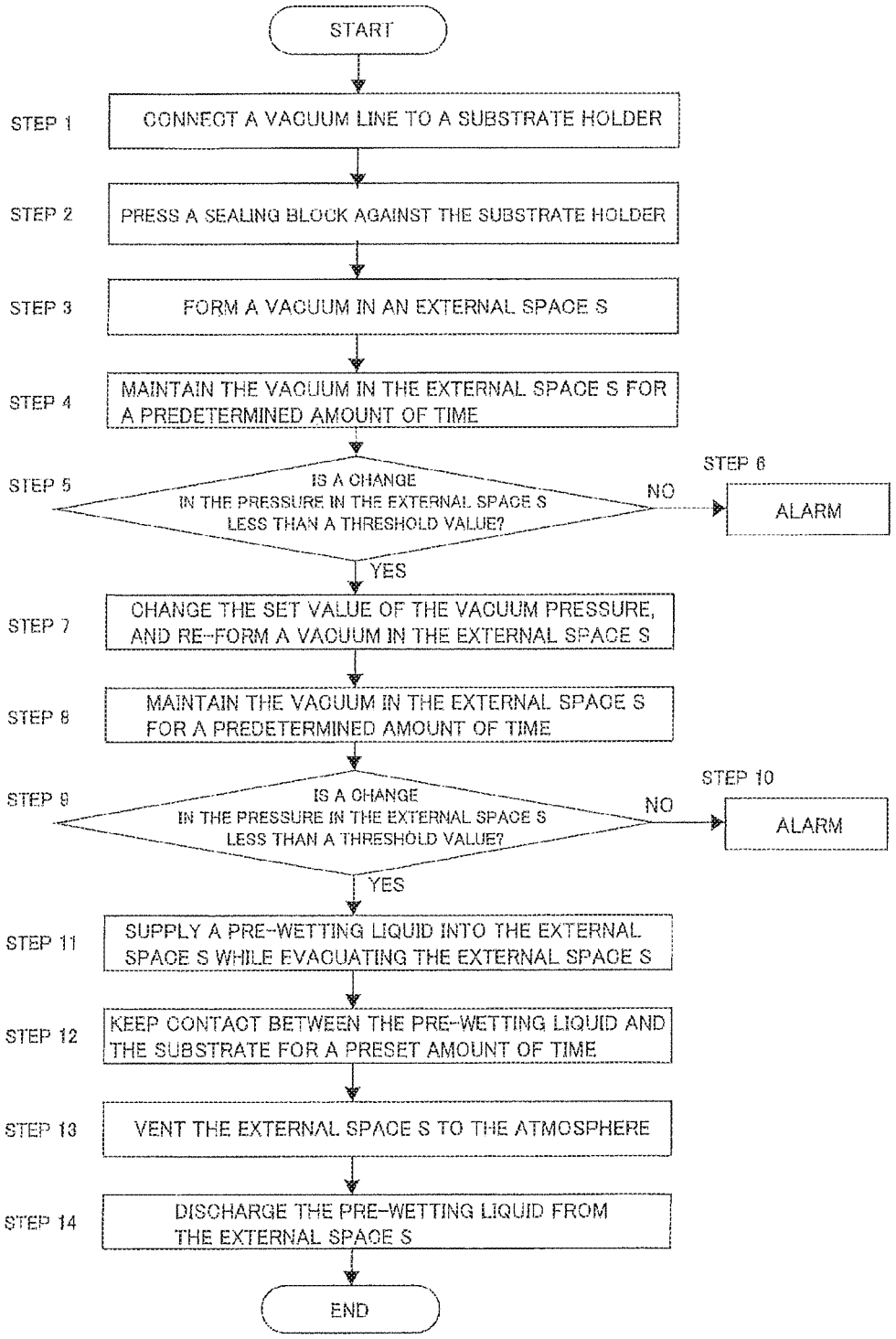
FIG. 8 is a flow chart showing an embodiment of a seal inspection and a pre-wetting treatment.

The seal inspection and the pre-wetting treatment are performed when the substrate holder 18 and the sealing block 140 are in the state shown in FIG. 7. FIG. 8 is a flow chart showing an embodiment of the seal inspection and the pre-wetting treatment. As described above, the holder suction line 121 of the vacuum line 114 is coupled to the substrate holder 18 disposed in the pre-wetting tank 26 (step 1). The sealing block 140 is pressed against the substrate holder 18, thereby forming the external space S (step 2). The processing controller 109 opens the on-off valves 118, 124*a*, 124*b*, 150 while keeping the on-off valve 130, the vent valve 138, the pre-wetting liquid supply valve 161, the drain valve 162 and the vent valve 172 closed, thereby forming a vacuum in the external space S and the master container 120 (step 3). Since the external space S and the master container 120 communicate with the common vacuum line 114, the pressure (negative pressure) in the external space S is equal to the pressure (negative pressure) in the master container 120. This pressure (negative pressure) may be, for example, not more than 200 Torr, more preferably not more than 100 Torr.

Next, while keeping the on-off valve 150 open, the processing controller 109 closes the on-off valves 124*a*, 124*b* to maintain the vacuum, formed in the external space S, for a predetermined amount of time (step 4). The processing controller 109 determines whether a change in the pressure in the external space S within the predetermined amount of time is less than a threshold value (step 5). The processing controller 109 can determine the change in the pressure in the external space S based on a change in the output signal from the differential-pressure sensor 126, i.e. based on a change in the difference between the pressure in the external space S and the pressure in the master container 120. More specifically, the processing controller 109 determines whether the difference between the pressure in the external space S and the pressure in the master container 120 within the predetermined amount of time is less than the threshold value.

By thus detecting the change in the pressure in the external space S with the use of the differential-pressure sensor 126 which measures the difference between the pressure in the external space S and the pressure in the master container 120 when the on-off valves 124*a*, 124*b* are closed, a very small change in the pressure in the external space S can be detected more accurately as compared to a case of directly measuring the change in the pressure in the external space S with use of a pressure sensor.

If the change in the pressure in the external space S within the predetermined amount of time is not less than the threshold value, it is conceivable that the sealing ridge 66 and/or the sealing ridge 68 does not properly provide a sealed state, that is, there is a malfunction of the sealing ridge 66 and/or the sealing ridge 68. In this case, therefore, the processing controller 109 emits an alarm (step 6).

If the change in the pressure in the external space S within the predetermined amount of time is less than the threshold value, the processing controller 109 changes a set value of the vacuum pressure, and re-forms a vacuum in the external space S (step 7). In order to prevent breakage of the substrate W, a vacuum may be formed in the internal spaces R1, R2 while a vacuum is formed in the external space S. While keeping the on-off valve 150 (and the on-off valve 130) open, the processing controller 109 closes the on-off valves 124*a*, 124*b* to maintain the vacuum, formed in the external space S, for a predetermined amount of time (step 8).

The processing controller 109 determines whether a change in the pressure in the external space S within the predetermined amount of time is less than a threshold value (step 9). The predetermined amount of time and the threshold value, set in the steps 8 and 9, may be equal to or different from the above-described predetermined amount of time and threshold value set in the above-described steps 4 and 5. The processing controller 109 can determine the change in the pressure in the external space S based on a change in the output signal from the differential-pressure sensor 126, i.e. based on a change in the difference between the pressure in the external space S and the pressure in the master container 120. More specifically, the processing controller 109 determines whether the difference between the pressure in the external space S and the pressure in the master container 120 within the predetermined amount of time is less than the threshold value.

If the change in the pressure in the external space S within the predetermined amount of time is not less than the threshold value, it is conceivable that the partition seal 144 of the sealing block 140 does not properly provide a sealed state, that is, there is a malfunction of the partition seal 144. In this case, therefore, the processing controller 109 emits an alarm (step 10).

Thus, in this embodiment, a first seal inspection for checking the sealed state provided by the sealing ridges 66, 68 of the substrate holder 18 is performed in accordance with the steps 3 to 6, and subsequently a second seal inspection for checking the sealed state provided by the partition seal 144 of the sealing block 140 is performed in accordance with the steps 7 to 10. The pre-wetting treatment, which will be described below, is performed using the substrate holder 18 and the sealing block 140 which have passed the first and second seal inspections.

If the change in the pressure in the external space S within the predetermined amount of time is less than the threshold value, the processing controller 109 opens the on-off valve 124*a* to establish the communication between the vacuum line 114 and the external space S (and the internal spaces R1, R2), thereby restarting evacuation of the external space S (and the internal spaces R1, R2). While evacuating air from the external space S (and the internal spaces R1, R2), the processing controller 109 opens the pre-wetting liquid supply valve 161 to supply a pre-wetting liquid into the external space S through the pre-wetting liquid supply line 155 (step 11). The processing controller 109 may open the on-off valve 124*a* and the pre-wetting liquid supply valve 161 simultaneously. The surface level of the pre-wetting liquid rises in the external space S until the pre-wetting liquid contacts the entirety of the exposed surface of the substrate W. The processing controller 109 keeps the on-off valve 124*a* and the pre-wetting liquid supply valve 161 open simultaneously at least for a predetermined period of time. The predetermined period of time is an expected period from when the supply of the pre-wetting liquid into the external space S is started to when the pre-wetting liquid contacts the entirety of the exposed surface of the substrate W.

When the surface level of the pre-wetting liquid becomes higher than the substrate W, the processing controller 109 closes the pre wetting liquid supply valve 161 to stop the supply of the pre-wetting liquid, and closes the on-off valves 124*a*, 150 (and the on-off valve 130) to stop the evacuation of the external space S (and the internal spaces R1, R2). The processing controller 109 may close the on-off valves 124*a*, 150 (and the on-off valve 130) simultaneously with the pre-wetting liquid supply valve 161. After stopping the evacuation of the internal spaces R1, R2, the processing controller 109 may open the vent valve 138 to make the internal spaces R1, R2 communicate with the atmosphere through the vent line 139.

According to this embodiment, the pre-wetting liquid is supplied into the external space S while the external space S is being evacuated. This operation can remove air bubbles from the pre-wetting liquid. Moreover, the pre-wetting liquid easily enters recesses or through-holes (such as via holes, trenches, etc.), formed in the surface of the substrate W under vacuum, whereby air, existing in the recesses or through-holes, is replaced with the pre-wetting liquid. Hydrophilicity is thus imparted to the surface of the substrate W. In this embodiment, pure water is used as the pre-wetting liquid. In one embodiment, the pre-wetting liquid may be deaerated pure water. The contact between the pre-wetting liquid and the substrate W is kept for a preset amount of time (step 12).

After the preset amount of time has elapsed, the processing controller 109 opens the vent valve 172 to make the external space S communicate with the atmosphere through the vent line 171 (step 13). Further, the processing controller 109 opens the drain valve 162 to discharge the pre-wetting liquid from the external space S through the drain line 156 (step 14). The processing controller 109 may open the vent valve 172 and the drain valve 162 simultaneously.

Though only pure water is supplied as the pre-wetting liquid in the above-described embodiment, the present invention is not limited to the use of the single pre-wetting liquid. For example, it is possible to (1) supply pure water as a first pre-wetting liquid into the external space S and hold the pure water therein for a certain amount of time, and then discharge the pure water from the external space S through the drain line 156, and to (2) subsequently supply a second pre-wetting liquid into the external space S while evacuating air from the external space S and hold the second pre-wetting liquid therein for a certain amount of time, and then discharge the second pre-wetting liquid from the external space S through the drain line 156. The second pre-wetting liquid may contain a small amount of an accelerator and chloride ions. Further, it is possible to (3) subsequently supply pure water as cleaning water into the external space S while evacuating air from the external space 5, and then discharge the pure water from the external space S through the drain line 156. By thus supplying the pre-wetting liquid into the external space S while evacuating air from the external space S, the pre-wetting liquid easily enters recesses or through-holes (such as via holes, trenches, etc.) formed in the surface of the substrate W. In order to supply the pre-wetting liquid into the external space S, the pre-wetting liquid supply port 152 may be provided with a nozzle having such a shape as to be capable of spraying fine liquid droplets onto a substrate.

According to this embodiment, the external space S is formed between the exposed surface of the substrate W held by the substrate holder 18 and the sealing block 140, and the pre-wetting liquid is supplied only to the external space S. This makes it possible to significantly reduce the amount of the pre-wetting liquid used as compared to the conventional method. Furthermore, since the pre-wetting liquid is injected into the external space S while evacuating air from the external space S, air bubbles can be removed from the pre-wetting liquid. In addition, the pre-wetting liquid can easily enter recesses or through-holes formed in the substrate W, thereby expelling air from the recesses or through-holes.

In one embodiment, a pretreatment may be performed after the seal inspection and the pre-wetting treatment. The pretreatment is a process of etching away an oxide film, formed in a surface of a conductive film, such as a seed layer, of a substrate. The pretreatment is also referred to as a pre-soaking treatment. In this embodiment, the seal inspection, the pre-wetting treatment and the pretreatment are performed in the pre-wetting tank 26 successively in the order of the seal inspection, the pre-wetting treatment and the pretreatment. During the seal inspection, the pre-wetting treatment and the pretreatment, the substrate holder 18 is kept in the same position in the pre-wetting tank 26.

Figure 9:
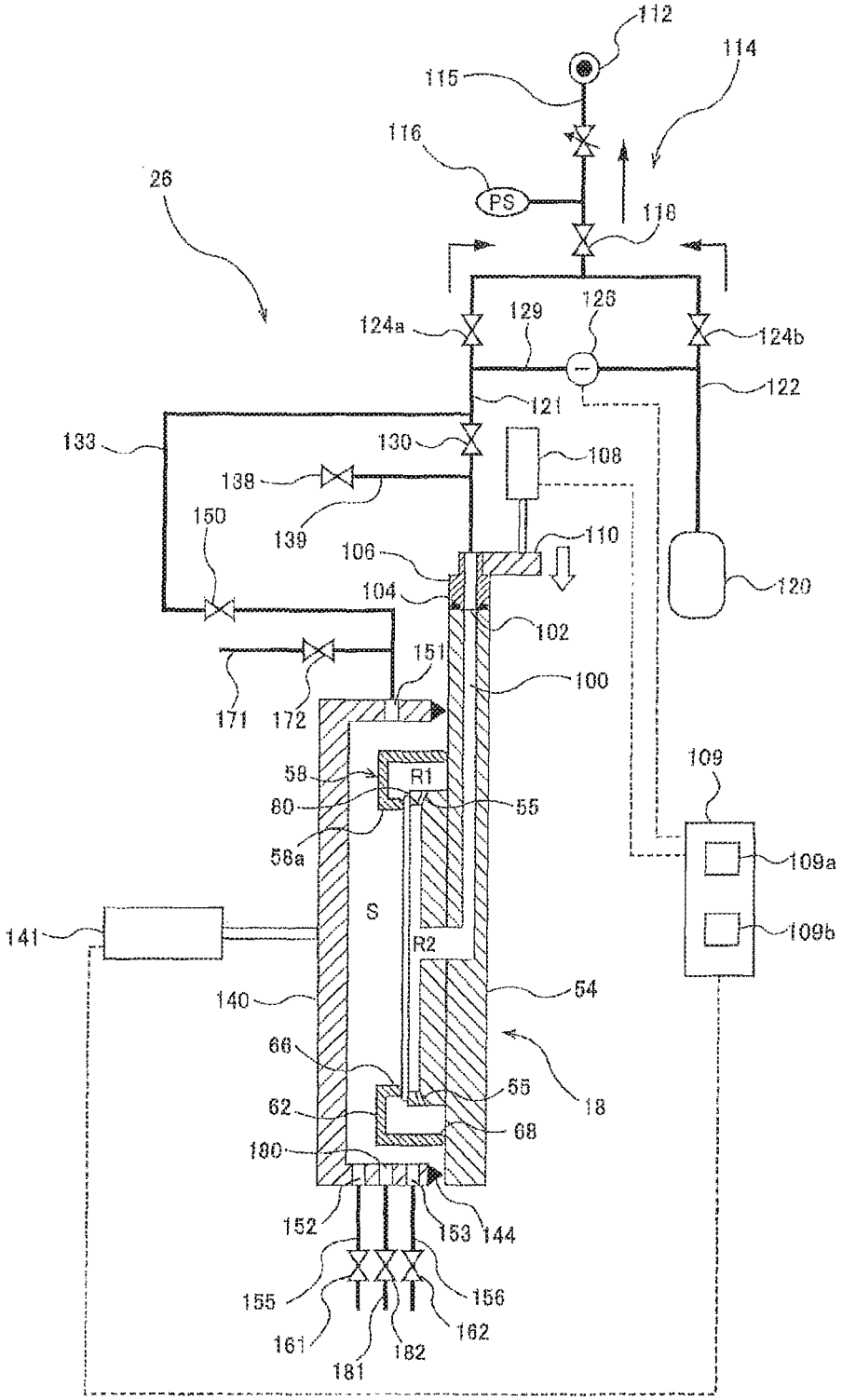
FIG. 9 is a diagram showing an embodiment of a construction which can perform a seal inspection, a pre-wetting treatment, and a pretreatment.

FIG. 9 is a diagram showing an embodiment of a construction which can perform the seal inspection, the pre-wetting treatment and the pretreatment. The embodiment shown in FIG. 9 differs from the embodiment shown in FIG. 7 in that a pretreatment liquid supply port 180 is formed in the sealing block 140, a pretreatment liquid supply line 181 is coupled to the pretreatment liquid supply port 180, and the pretreatment liquid supply line 181 is provided with a pretreatment liquid supply valve 182. The other construction of this embodiment is the same as the construction shown in FIG. 7, and a duplicated description thereof is omitted. The pretreatment liquid supply port 180 is located at the bottom of the sealing block 140 disposed in a vertical position. In this embodiment, the pretreatment liquid supply port 180 is located between the pre-wetting liquid supply port 152 and the drain port 153.

Figure 10:
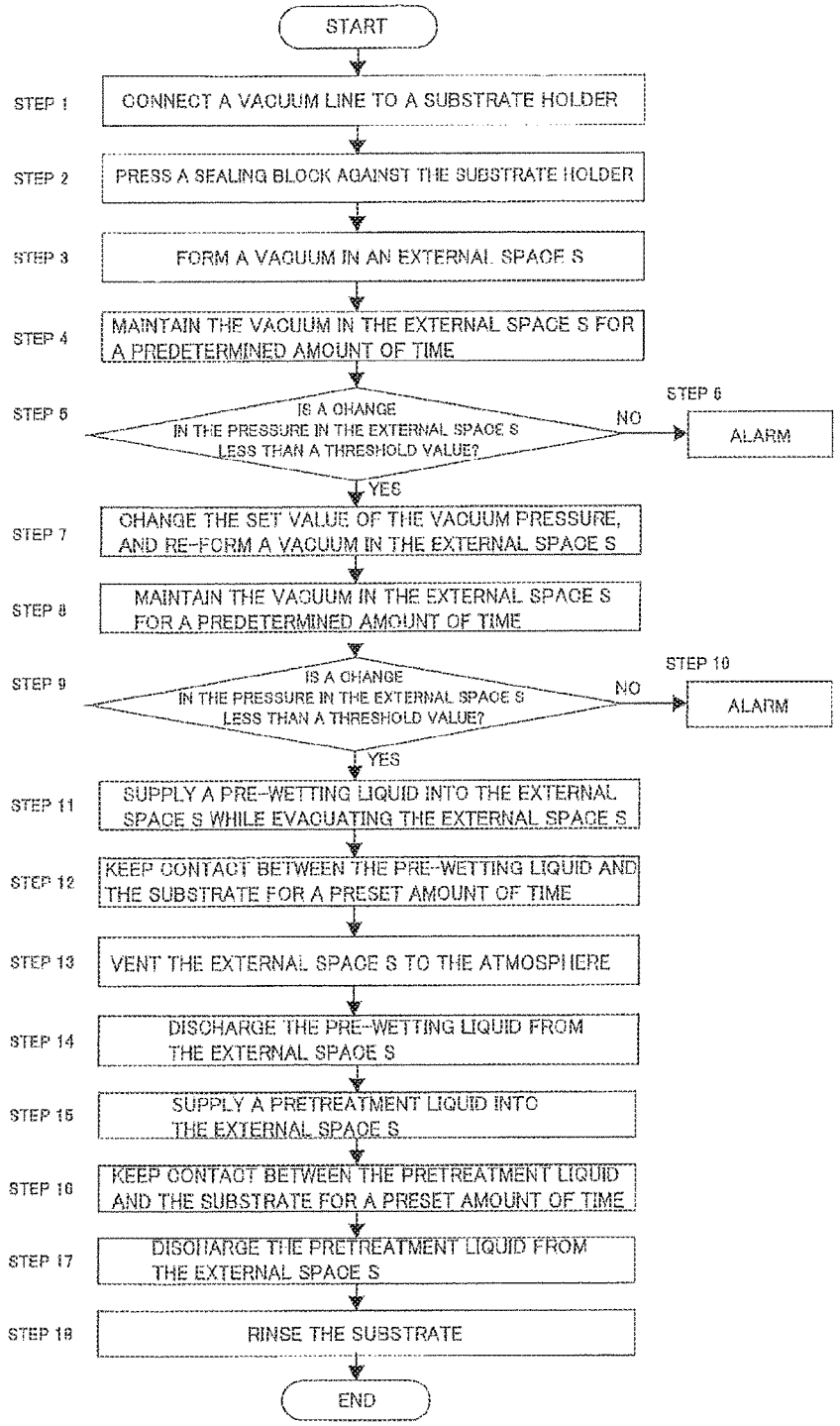
FIG. 10 is a flow chart showing an embodiment of a seal spection, a pre-wetting treatment, and a pretreatment.

FIG. 10 is a flow chart showing an embodiment of the seal inspection, the pre-wetting treatment and the pretreatment. The steps 1 to 14 shown in FIG. 10 are the same as the steps 1 to 14 shown in FIG. 8. In step 15, while keeping the drain valve 162 closed, the processing controller 109 opens the pretreatment liquid supply valve 182 to supply a pretreatment liquid (which is also referred to as a pre-soaking liquid) into the external space S through the pretreatment liquid supply line 181 and bring the pretreatment liquid into contact with the entire exposed surface of the substrate W. When the surface level of the pretreatment liquid becomes higher than the substrate W, the processing controller 109 closes the pretreatment liquid supply valve 182.

The contact between the pretreatment liquid and the substrate W is kept for a preset amount of time (step 16). After the preset amount of time has elapsed, the processing controller 109 opens the drain valve 162 to discharge the pretreatment liquid from the external space S through the drain line 156 (step 17). After the pretreatment, rinsing of the substrate W is performed (step 18). Since pure water is used as the pre-wetting liquid in this embodiment, pure water as rinsing water is supplied into the external space S through the pre-wetting liquid supply line 155. In particular, the processing controller 109 opens the pre-wetting liquid supply valve 161 to supply pure water, which is used as the pre-wetting liquid, into the external space S and bring the pure water into contact with the entire exposed surface of the substrate W. Thereafter, the processing controller 109 opens the drain valve 162 to discharge the pure water from the external space S through the drain line 156.

Since pure water is used as the pre-wetting liquid in this embodiment, the pre-wetting liquid supply line 155 also functions as a rinsing water supply line for supplying pure water as rinsing water into the external space S. In a case where pure water is not used as the pre-wetting liquid, a rinsing water supply line for supplying rinsing water, comprising pure water, into the external space S may be coupled to the sealing block 140.

According to this embodiment, the pretreatment and the rinsing of the substrate W are performed in the pre-wetting tank 26 after the seal inspection and the pre-wetting treatment, and therefore the above-described pretreatment tank 28 and first water cleaning tank 30*a* can be omitted. Thus, a reduction of the overall size of the plating apparatus can be achieved.

Figure 11:
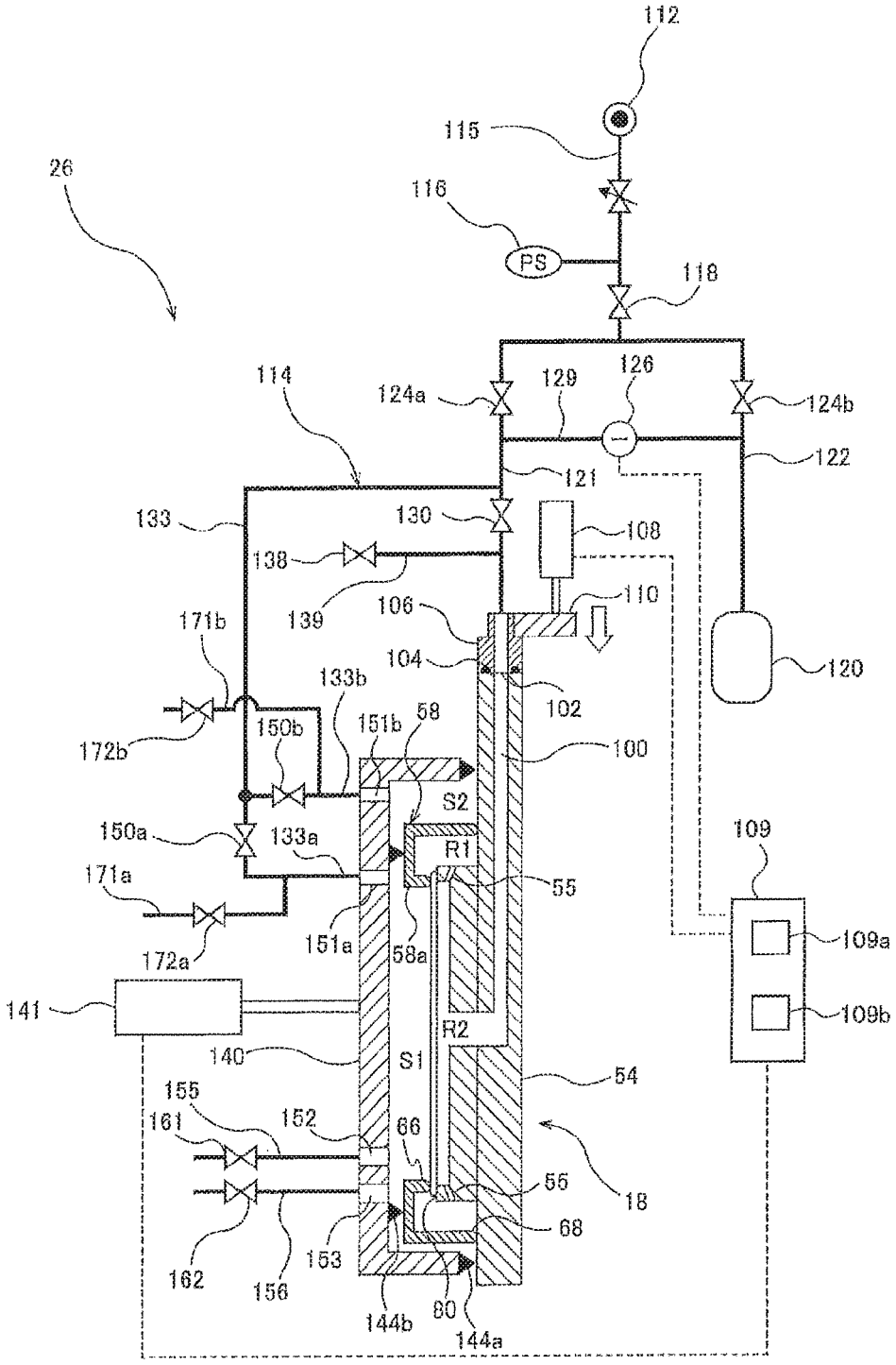
FIG. 11 is a diagram showing another embodiment of a construction for performing a seal inspection and a pre-wetting treatment.

Another embodiment of the sealing block 140 will now be described. FIG. 11 is a diagram showing another embodiment of a construction for performing the seal inspection and the pre-wetting treatment. The construction of this embodiment, not particularly described here, is the same as the construction shown in FIG. 7, and a duplicate description thereof is omitted.

The sealing block 140 has an endless first partition seal 144*a* and an endless second partition seal 144*b*. The first partition seal 144*a* corresponds to the partition seal 144 in the above-described embodiment. In this embodiment, the first partition seal 144*a* and the second partition seal 144*b* each have an annular shape. The second partition seal 144*b* has a smaller size than the first partition seal 144*a*, and is disposed inside the first partition seal 144*a*. When the actuator 141 presses the sealing block 140 against the substrate holder 18, the first partition seal 144*a* comes into contact with the first holding member 54 of the substrate holder 18, and the second partition seal 144*b* comes into contact with the second holding member 58 of the substrate holder 18.

When the sealing block 140 is being pressed against the substrate holder 18, a first external space S1 is formed by the exposed surface of the substrate W, the substrate holder 18 and the sealing block 140, and a second external space S2 is formed by the substrate holder 18 and the sealing block 140. The first external space S1 and the second external space S2 are separated by the second partition seal 144*b*. The first external space S1 and the second external space S2 are independent spaces which are in no fluid communication with each other. On the other hand, the internal space R1 and the internal space R2, formed in the substrate holder 18, communicate with each other through the passages 55.

The sealing-block suction line 133 of the vacuum line 114 has a first branch line 133*a* and a second branch line 133*b*. The first branch line 133*a* and the second branch line 133*b* are provided with an on-off valve 150*a* and an on-off valve 150*b*, respectively. A first exhaust port 151*a* and a second exhaust port 151*b* are formed in the sealing block 140. The first branch line 133*a* and the second branch line 133*b* are coupled to the first exhaust port 151*a* and the second exhaust port 151*b*, respectively.

The first exhaust port 151*a* is located inside the second partition seal 144*b*, while the second exhaust port 151*b* is located outside the second partition seal 144*b* and inside the first partition seal 144*a*. The first branch line 133*a* communicates with the first external space S1 through the first exhaust port 151*a*, while the second branch line 133*b* communicates with the second external space S2 through the second exhaust port 151*b*.

A first vent line 171*a* is coupled to the first branch line 133*a*. The first vent line 171*a* is located between the on-off valve 150*a* and the first exhaust port 151*a*. A second vent line 171*b* is coupled to the second branch line 133*b*. The second vent line 171*b* is located between the on-off valve 150*b* and the second exhaust port 151*b*. The first vent line 171*a* and the second vent line 171*b* are provided with a first vent valve 172*a* and a second vent valve 172*b*, respectively.

The first exhaust port 151*a* is located higher than the pre-wetting liquid supply port 152 and the drain port 153. More specifically, the first exhaust port 151*a* communicates with a top portion of the first external space S1, while the pre-wetting liquid supply port 152 and the drain port 153 communicate with bottom portion of the first external space S1.

Figure 12:
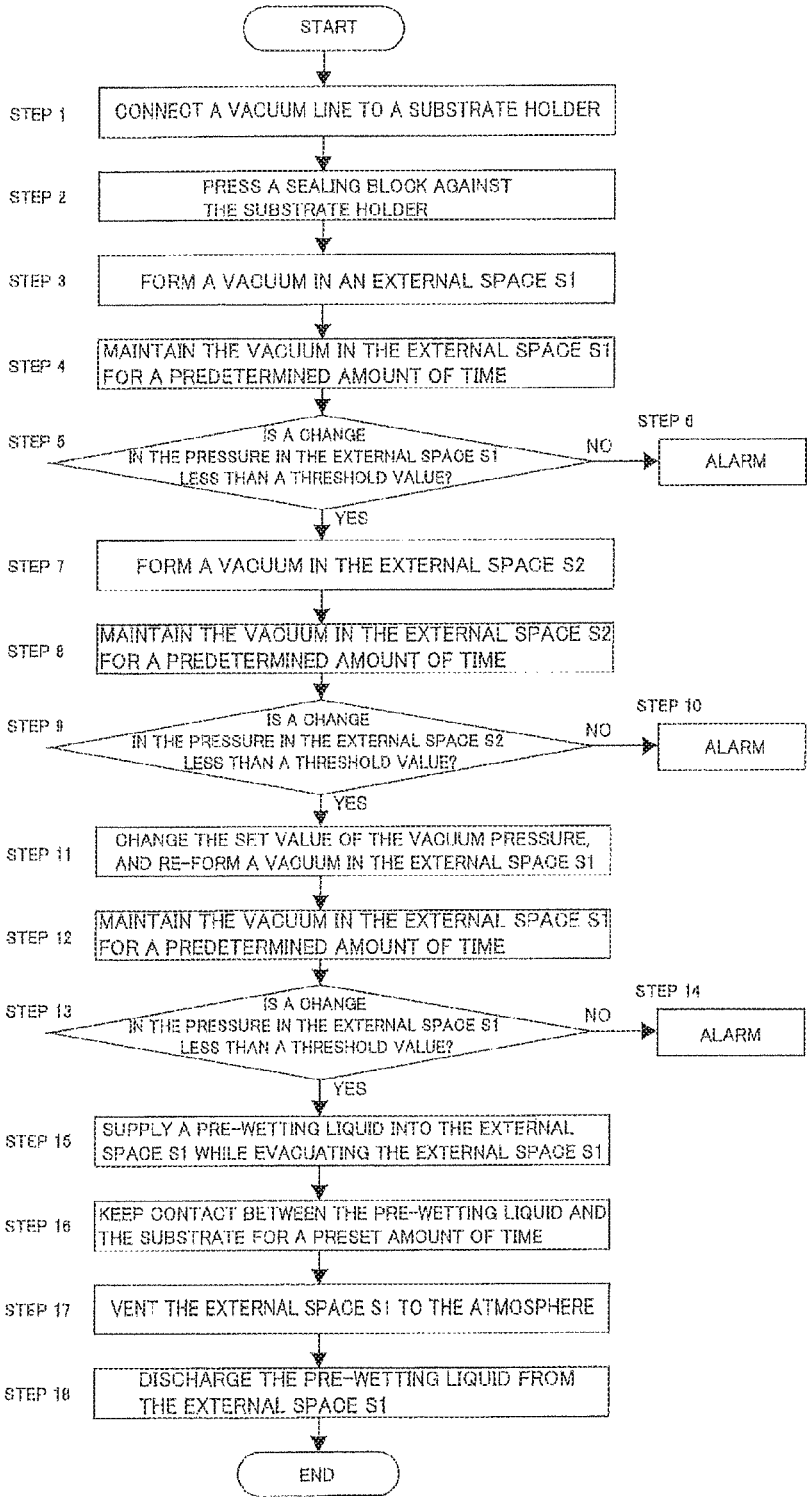
FIG. 12 is a flow chart showing another embodiment of a seal inspection and a pre-wetting treatment.

In this embodiment, the seal inspection and the pre-wetting treatment are performed when the substrate holder 18 and the sealing block 140 are in the state shown in FIG. 11. FIG. 12 is a flow chart showing another embodiment of the seal inspection and the pre-wetting treatment. As described above, the holder suction line 121 of the vacuum line 114 is coupled to the substrate holder 18 disposed in the pre-wetting tank 26 (step 1). The sealing block 140 is pressed against the substrate holder 18, thereby forming the first external space S1 and the second external space S2 (step 2). The processing controller 109 opens the on-off valves 118, 124*a*, 124*b*, 150*a* while keeping the on-off valves 130, 150*b*, the vent valve 138, the pre-wetting liquid supply valve 161, the drain valve 162 and the vent valve 172 closed, thereby forming a vacuum in the first external space Si and the master container 120 (step 3).

Next, while keeping the on-off valve 150*a* open, the processing controller 109 closes the on-off valves 124*a*, 124*b* to maintain the vacuum, formed in the first external space S1, for a predetermined amount of time (step 4). The processing controller 109 determines whether a change in the pressure in the first external space SI within the predetermined amount of time is less than a threshold value (step 5). The processing controller 109 can determine the change in the pressure in the first external space S1 based on a change in the output signal from the differential-pressure sensor 126, i.e. based on a change in the difference between the pressure in the first external space Si and the pressure in the master container 120. More specifically, the processing controller 109 determines whether the difference between the pressure in the first external space S1 and the pressure in the master container 120 within the predetermined amount of time is less than the threshold value.

If the change in the pressure in the first external space S1 within the predetermined amount of time is not less than the threshold value, it is conceivable that the sealing ridge 66 does not properly provide a sealed state, that is, there is a malfunction of the sealing ridge 66. In this case, therefore, the processing controller 109 emits an alarm (step 6).

If the change in the pressure in the first external space S1 within the predetermined amount of time is less than the threshold value, the processing controller 109 closes the on-off valve 150*a*. The vacuum in the first external space S1 is maintained as it is. Further, the processing controller 109 opens the on-off valves 124*a*, 124*b*, 150*b* to form a vacuum in the second external space S2 and the master container 120 (step 7). Next, while keeping the on-off valve 150*b* open, the processing controller 109 closes the on-off valves 124*a*, 124*b* to maintain the vacuum, formed in the second external space S2, for a predetermined amount of time (step 8).

The processing controller 109 determines whether a change in the pressure in the second external space S2 within the predetermined amount of time is less than a threshold value (step 9). The processing controller 109 can determine the change in the pressure in the second external space S2 based on a change in the output signal from the differential-pressure sensor 126, i.e. based on a change in the difference between the pressure in the second external space S2 and the pressure in the master container 120. More specifically, the processing controller 109 determines whether the difference between the pressure in the second external space S2 and the pressure in the master container 120 within the predetermined amount of time is less than the threshold value.

If the change in the pressure in the second external space S2 within the predetermined amount of time is not less than the threshold value, it is conceivable that the sealing ridge 68 does not properly provide a sealed state, that is, there is a malfunction of the sealing ridge 68. In this case, therefore, the processing controller 109 emits an alarm (step 10). Thus, this embodiment makes it possible to determine which of the sealing ridge (first sealing ridge) 66 and the sealing ridge (second sealing ridge) 68 has a defect.

If the change in the pressure in the second external space S2 within the predetermined amount of time is less than the threshold value, the processing controller 109 closes the on-off valve 150*b*, and then opens the vent valve 172*b* to make the second external space S2 communicate with the atmosphere. Subsequently, the processing controller 109 changes a set value of the vacuum pressure, and re-forms a vacuum in the first external space S1 (step 11). In order to prevent breakage of the substrate W, a vacuum may be formed in the internal spaces R1, R2 while a vacuum is formed in the first external space S1. While keeping the on-off valve 150*a* (and the on-off valve 130) open, the processing controller 109 closes the on-off valves 124*a*, 124*b* to maintain the vacuum, formed in the first external space S1, for a predetermined amount of time (step 12).

The processing controller 109 determines whether a change in the pressure in the first external space S1 within the predetermined amount of time is less than a threshold value (step 13). The predetermined amount of time and the threshold value, set in the steps 12 and 13, may be equal to or different from the above-described predetermined amount of time and threshold value set in the above-described steps 4 and 5. The processing controller 109 can determine the change in the pressure in the first external space S1 based on a change in the output signal from the differential-pressure sensor 126, i.e. based on a change in the difference between the pressure in the first external space S1 and the pressure in the master container 120. More specifically, the processing controller 109 determines whether the difference between the pressure in the first external space S1 and the pressure in the master container 120 within the predetermined amount of time is less than the threshold value.

If the change in the pressure in the first external space S1 within the predetermined amount of time is not less than the threshold value, it is conceivable that the second partition seal 144*b* of the sealing block 140 does not properly provide a sealed state, that is, there is a malfunction of the second partition seal 144*b*. In this case, therefore, the processing controller 109 emits an alarm (step 14).

Thus, also in this embodiment, a first seal inspection for checking the sealed state provided by the sealing ridges 66, 68 of the substrate holder 18 is performed in accordance with the steps 3 to 10, and subsequently a second seal inspection for checking the sealed state provided by the second partition seal 144*b* of the sealing block 140 is performed in accordance with the steps 11 to 14. The pre-wetting treatment, which will be described below, is performed using the substrate holder 18 and the sealing block 140 which have passed the first and second seal inspections.

If the change in the pressure in the first external space S1 within the predetermined amount of time is less than the threshold value, the processing controller 109 opens the on-off valve 124*a* to make the vacuum line 114 communicate with the first external space S1 (and the internal spaces R1, R2), thereby restarting evacuation of the first external space S1 (and the internal spaces R1, R2). While evacuating the first external space S1 (and the internal spaces R1, R2), the processing controller 109 opens the pre-wetting liquid supply valve 161 to supply a pre-wetting liquid into the first external space Si through the pre-wetting liquid supply line 155 (step 15). The processing controller 109 may open the on-off valve 124*a* and the pre-wetting liquid supply valve 161 simultaneously. The surface level of the pre-wetting liquid rises in the first external space S1, until the pre-wetting liquid comes into contact with the entirety of the exposed surface of the substrate W. The processing controller 109 keeps the on-off valve 124*a* and the pre-wetting liquid supply valve 161 open simultaneously at least for a predetermined period of time. This predetermined period of time is an expected period from when the supply of the pre-wetting liquid into the first external space S1 is started to when the pre-wetting liquid contacts the entirety of the exposed surface of the substrate W.

When the surface level of the pre-wetting liquid becomes higher than the substrate W, the processing controller 109 closes the pre-wetting liquid supply valve 161 to stop the supply of the pre-wetting liquid, and closes the on-off valves 124*a*, 150*a* (and the on-off valve 130) to stop the evacuation of the first external space S1 (and the internal spaces R1, R2). The processing controller 109 may close the on-off valves 124*a*, 150*a* (and the on-off valve 130) simultaneously with the pre-wetting liquid supply valve 161. After stopping the evacuation of the internal spaces R1, R2, the processing controller 109 may open the vent valve 138 to make the internal spaces R1, R2 communicate with the atmosphere through the vent line 139.

The timing for stopping the supply of the pre-wetting liquid may be when a predetermined management time has elapsed. For example, it is possible to measure in advance the time it takes for the surface level of the pre-wetting liquid to become higher than the substrate W and define the measured time as a management time, and to stop the supply of the pre-wetting liquid after the elapse of the management time. As an alternative, the vent lines 171, 171*a* and 171*b* may each be provided with a not-shown liquid detection sensor so that when the liquid detection sensors detect that the pre-wetting liquid has reached one of the vent lines 171, 171*a* and 171*b*, the processing controller 109, based on the detection signal, closes the pre-wetting liquid supply valve 161 to stop the supply of the pre-wetting liquid.

The contact between the pre-wetting liquid and the substrate W is kept for a preset amount of time (step 16). After the preset amount of time has elapsed, the processing controller 109 opens the vent valve 172*a* to make the first external space S1 communicate with the atmosphere through the vent line 171*a* (step 17). Further, the processing controller 109 opens the drain valve 162 to discharge the pre-wetting liquid from the first external space S through the drain line 156 (step 18). The processing controller 109 may open the vent valve 172*a* and the drain valve 162 simultaneously. The drain line 156 may be provided with a liquid detection sensor. It is possible to complete the treatment when no pre-wetting liquid is detected by the liquid detection sensor after all the pre-wetting liquid has been discharged from the first external space S1 through the drain line 156. The processing controller 109 then closes the drain valve 162.

As with the above-described embodiment, a pretreatment may be performed after the seal inspection and the pre-wetting treatment. The construction for performing the pretreatment may be the same as the construction described above with reference to the embodiment shown in FIGS. 9 and 10. As with the seal inspection and the pre-wetting treatment, the pretreatment is performed in the pre-wetting tank 26, where the substrate holder 18 is kept in the same position as in the seal inspection and the pre-wetting treatment. The pretreatment is performed in this embodiment in the same manner as described above with reference to the embodiment shown in FIGS. 9 and 10, and a duplicated description thereof is omitted.

Figure 13:
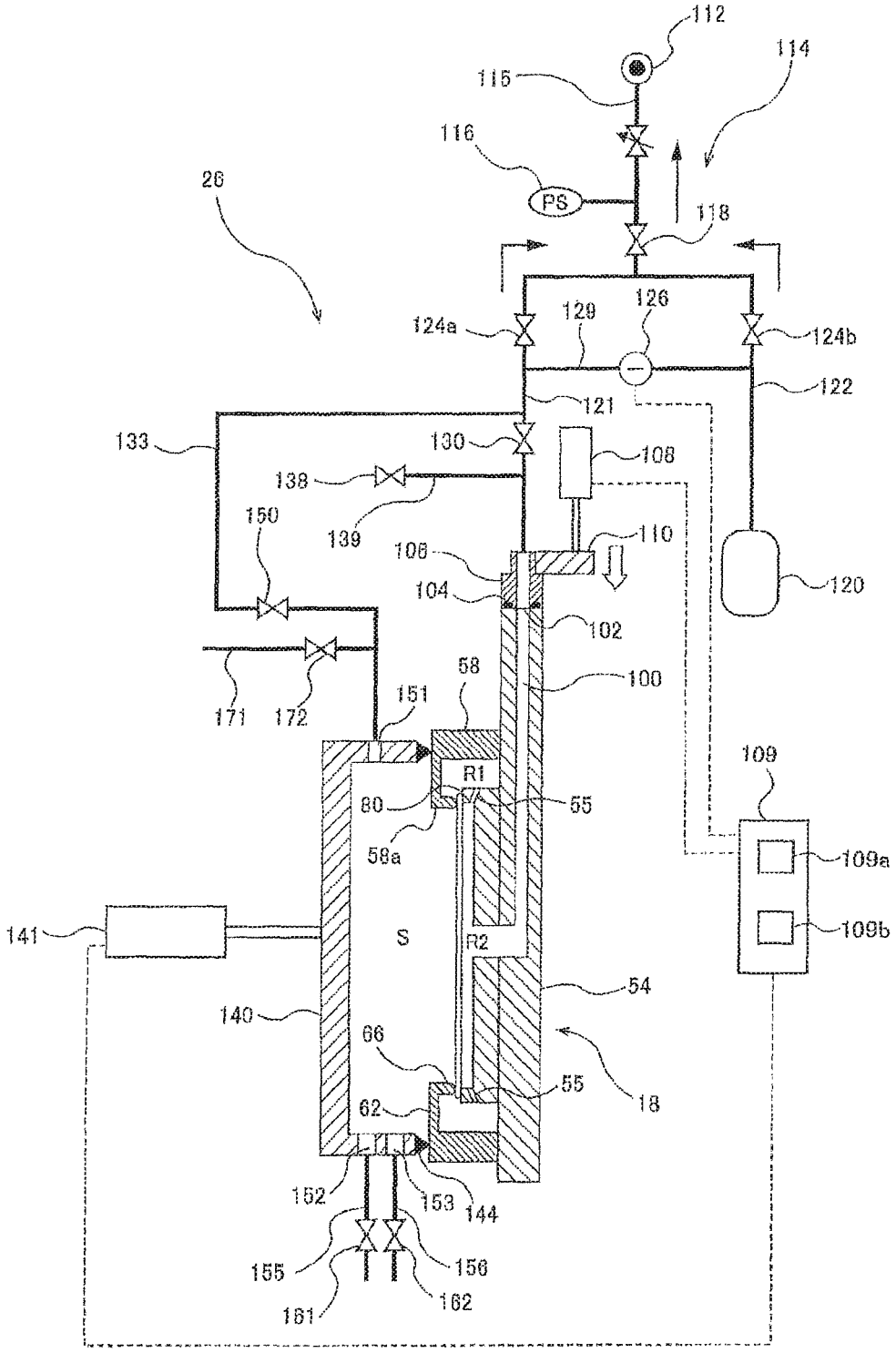
FIG. 13 is a diagram showing yet another embodiment of a construction for perforating a seal inspection and a pre-wetting treatment.

Yet another embodiment of the sealing block 140 will now be described. FIG. 13 is a diagram showing yet another embodiment of a construction for performing the seal inspection and the pre-wetting treatment. The construction of this embodiment, not particularly described here, is the same as the construction shown in FIGS. 6 and 7, and a duplicate description thereof is omitted.

In this embodiment, the substrate holder 18 has the substrate-side sealing ridge (first sealing ridge) 66, but does not have the holder-side sealing ridge (second sealing ridge) 68. The size of the sealing block 140 is equal to or smaller than the size of the second holding member 58. Further, the size of the sealing block 140 is larger than the size of the sealing ridge 66 of the second holding member 58. When the sealing block 140 is pressed against the substrate holder 18 by the actuator 141, the partition seal 144 comes into contact with the second holding member 58 of the substrate holder 18. The sealing ridge 66 and the exposed surface of the substrate W are covered by the sealing block 140. When the sealing block 140 is pressed against the substrate holder 18, an external space S is formed by the sealing block 140, the exposed surface of the substrate W, and the substrate holder 18.

The exhaust port 151 is located at the top of the sealing block 140 disposed in a vertical position, while the pre-wetting liquid supply port 152 and the drain port 153 are located at the bottom of the sealing block 140 disposed in a vertical position. The exhaust port 151 is located above the sealing ridge 66, while the pre-wetting liquid supply port 152 and the drain port 153 are located below the sealing ridge 66. Accordingly, the exhaust port 151 is located higher than the exposed surface of the substrate W, while the pre-wetting liquid supply port 152 and the drain port 153 are located lower than the exposed surface of the substrate W.

The seal inspection and the pre-wetting treatment according to this embodiment are performed by following the flow chart shown in FIG. 8, and a duplicate description thereof is omitted. After the pre-wetting treatment, the pretreatment and the rinsing treatment may be performed by following the flow chart shown in FIG. 10. This embodiment is suited for a pre-wetting tank which performs the pre-wetting treatment while keeping the substrate holder 18 in a horizontal position.

While the substrate W used in the above-described embodiments is a circular substrate such as a wafer, the present invention can be applied also to a quadrangular substrate. Components of a substrate holder for holding a quadrangular substrate have shapes that conform to the shape of the quadrangular substrate. For example, the above-described opening 58*a* may be a quadrangular opening which is smaller than the overall size of the quadrangular substrate. Various sealing elements, such as the substrate-side sealing ridge 66 and the holder-side sealing ridge 68, may each have a shape that conforms to the shape of the quadrangular substrate. The shapes of other components may also be appropriately modified without departing from the technical concept described herein.

In order to keep the pre-wetting tank 26 and the sealing block 140 clean when substrates are plated in a successive manner, it is possible to automatically clean the interior (including the sealing block 140) of the pre-wetting tank 26 by supplying a cleaning liquid, such as pure water (DIW), from a not-shown cleaning nozzle (e.g. a spray nozzle) at times when no substrate holder is held in the pre-wetting tank 26. The timing for terminating the cleaning may be determined, for example, by counting the number of particles contained in a waste cleaning liquid with a particle counter. Such cleaning makes it possible to perform the sequence of plating process steps: the seal inspection; the pre-wetting treatment; and the pretreatment, in the pre-wetting tank 26 automatically and successively on a plurality of substrates.

Though the foregoing description illustrates the pre-wetting treatment of a substrate with the use of a dip-type substrate holder which is immersed in a vertical position in a plating solution, the present invention can also be applied to the pre-wetting treatment of a substrate with the use of a cup-type substrate holder which holds a substrate in a horizontal position or an inclined position with its to-be-processed surface facing downward in a plating solution that is supplied from below the substrate.

The foregoing description is presented to enable a person of ordinary skill in the art to make and use the invention. Various modifications to the embodiments described above will be readily apparent to those of ordinary skill in the art and the technical concept of the present invention may be applied to other embodiments. Accordingly, the present invention is not intended to be limited to the embodiments illustrated but is to be accorded the widest scope consistent with the technical concept defined by the appended claims.

What is claimed is:

1. A method of processing a surface of a substrate while holding the substrate with a substrate holder including a first holding member and a second holding member, the second holding member having an opening, said method comprising:

holding the substrate with the substrate holder by sandwiching the substrate between the first holding member and the second holding member, with the surface of the substrate being exposed through the opening of the second holding member, and pressing a sealing ridge of the substrate holder against a peripheral portion of the substrate to form an internal space in the substrate holder;

pressing a sealing block against the substrate holder to cover the sealing ridge, to form an external space defined by the substrate holder, the exposed surface of the substrate, and the sealing block;

forming a vacuum in the external space to create a pressure difference between the internal space and the external space;

performing a seal inspection to check a sealed state provided by the sealing ridge based on a change in pressure in the external space; and performing a pre-wetting treatment by supplying a pre-wetting liquid to the external space while evacuating air from the external space to bring the pre-wetting liquid into contact with the exposed surface of the substrate.

2. The method according to claim 1, wherein the seal inspection and the pre-wetting treatment are performed successively in a pre-wetting tank.

3. The method according to claim 1, wherein the seal inspection and the pre-wetting treatment are performed while keeping the substrate holder, holding the substrate, in a vertical position.

4. The method according to claim 1, further comprising:

re-forming a vacuum in the external space after the seal inspection and before the pre-wetting treatment; and checking a sealed state provided by the sealing block based on a change in pressure in the external space.

5. The method according to claim 1, further comprising:

discharging the pre-wetting liquid from the external space after the pre-wetting treatment; and then performing a pretreatment by supplying a pretreatment liquid to the external space to bring the pretreatment liquid into contact with the exposed surface of the substrate.

6. The method according to claim 5, wherein the seal inspection, the pre-wetting treatment, and the pretreatment are performed successively in a pre-wetting tank.

7. The method according to claim 1, further comprising:

before the pre-wetting treatment, forming a vacuum in the internal space while the vacuum is formed in the external space for preventing breakage of the substrate.

* * * * *